US011052407B1

(12) United States Patent
Han et al.

(10) Patent No.: US 11,052,407 B1
(45) Date of Patent: Jul. 6, 2021

(54) DIELECTROPHORETIC IN-DROPLET MATERIAL CONCENTRATOR

(71) Applicant: THE TEXAS A&M UNIVERSITY SYTEM, College Station, TX (US)

(72) Inventors: Arum Han, College Station, TX (US); Song-I Han, College Station, TX (US)

(73) Assignee: THE TEXAS A&M UNIVERSITY SYSTEM, College Station, TX (US)

( * ) Notice: Subject to any disclaimer, the term of this patent is extended or adjusted under 35 U.S.C. 154(b) by 163 days.

(21) Appl. No.: 16/257,783

(22) Filed: Jan. 25, 2019

Related U.S. Application Data

(60) Provisional application No. 62/623,043, filed on Jan. 29, 2018.

(51) Int. Cl.
*B03C 5/02* (2006.01)
*B01L 3/00* (2006.01)

(52) U.S. Cl.
CPC ..... *B03C 5/026* (2013.01); *B01L 3/502784* (2013.01); *B01L 2200/0652* (2013.01); *B01L 2300/0809* (2013.01); *B01L 2400/043* (2013.01); *B01L 2400/0424* (2013.01); *B03C 2201/18* (2013.01)

(58) Field of Classification Search
None
See application file for complete search history.

(56) References Cited

U.S. PATENT DOCUMENTS

2015/0232942 A1* 8/2015 Abate ..... C12Q 1/686 506/9

FOREIGN PATENT DOCUMENTS

WO WQ-2004074814 A2 * 9/2004 ..... B03C 5/026

OTHER PUBLICATIONS

C.-Y. Huang, et al. "Label-Free Separation and Sorting of Human Monocytes and T-cells by Electrowetting and Dielectrophoresis", In The 8th Annual IEEE International Conference on Nano/Micro Engineered and Molecular Systems Apr. 7, pp. 873-876 (Year: 2013).*

* cited by examiner

*Primary Examiner* — J. Christopher Ball
(74) *Attorney, Agent, or Firm* — Conley Rose, P.C.

(57) ABSTRACT

A dielectrophoresis-based in-droplet cell concentrator is disclosed herein. The concentrator can include a concentration microchannel having an input port and two or more outlet ports. The input port introduces cell-encapsulated droplets or particle-encapsulated droplets into the microchannel; a first outlet port receives droplets including most of the cells or particles and a second output port receives droplets including few cells or particles. The concentrator also can include a pair of electrodes. When voltage is applied, the electrodes will create an electric field across the microchannel. The concentrator adds new capabilities to droplet microfluidics operations, such as adjusting concentrations of cells in droplets, separating cells of different properties from inside droplets, and solution exchange.

21 Claims, 17 Drawing Sheets

DIELECTROPHORETIC IN-DROPLET MATERIAL CONCENTRATOR

RELATED APPLICATIONS

This application claims priority to U.S. Provisional Patent Application No. 62/623,043 filed on Jan. 29, 2018, which is specifically incorporated by reference in its entirety herein.

GOVERNMENT FUNDING

This invention was made with government support under grant EFRI 1240478 awarded by the National Science Foundation. The government has certain rights in the invention.

FIELD

The disclosure relates generally to an apparatus and method for separation or concentration of cells. The disclosure relates specifically to an apparatus and method for separation or concentration of cells in droplet microfluidic systems.

BACKGROUND

The miniaturization technologies based on droplet-based microfluidic systems have been developed for broad ranges of applications such as chemical reactions, immuno-molecular assays, drug screening, cancer biology, immunology, biochemistry, microbiology, biomaterial science, synthetic biology, systems biology, cell biology, and other applications. Droplets can be generated using two immiscible solutions (oil in water or water in oil), and the most interesting aspect of the droplet microfluidics method is that it can generate independent nano or pico liter volume vessels that can encapsulate target samples within, functioning as independent bioreactors. By generating and manipulating large numbers of such droplets, high-throughput assays are possible. In almost all areas of life science disciplines, droplet microfluidics is now starting to play an important role due to its high-throughput nature. Importantly, the device and methods envisioned here have applications outside of life science per se, including but not limited, applications in materials science, polymer chemistry, and synthetic chemistry.

Extensive research into droplet microfluidics resulted in that almost all liquid sample handling steps commonly used in life science assays commonly used in laboratory setting can be conducted in droplet format. These include generation of droplets with a particular volume (i.e., metering liquid volume), generation of droplets containing a predetermined number of cells (i.e., controlling cell concentration, as low as a single cell in a droplet), merging two or more droplets (i.e., reagent mixing steps), measuring droplet contents (e.g., fluorescence measurement), splitting droplets (i.e. aliquoting), sorting/retrieving droplets, and many other liquid/cell handling steps. The one remaining fundamental liquid sample step that has not been achieved so far is the solution washing step and concentrating the cells or particles in droplets. In addition, separating materials of different properties within a given droplet also remains a challenge. In an embodiment, the materials are cells or particles.

Centrifugation is a fundamental step in a biological assay to either change the solution in which cells are suspended, including cell washing, or to change the concentration of the cell suspension (either higher or lower). Centrifugation plays a similarly important role in a wide variety of material science applications. However, such centrifugation step has not been achieved in droplet format. One way to achieve this in droplet format, using cells as an example, is to first concentrate cells inside a droplet to one side of the droplet, followed by splitting the droplet into two or more droplets. Recovering the split daughter droplet where the majority (or all) of the cells reside is similar to removing supernatant after centrifugation and retrieving the cells in the bottom of a centrifuge tube, recovering just the cells. As an additional step, merging this split droplet with another droplet containing the desired reagent would be similar to re-suspending the pelleted cells in another media. Thus, if it becomes possible to concentrate cells inside a droplet, followed by droplet splitting and subsequent merging with another droplet containing target reagent, one of the last remaining liquid handling steps that was previously not achievable in droplet format can be accomplished. Thus, a major hurdle so far in further expanding the powerful droplet microfluidics platform into broader applications can be overcome.

Furthermore, not only concentrating materials to one side of the droplet, but separating cells within the droplets based on their properties (either intrinsic or achieved through tagging of target cells), is another in-droplet cell or particle manipulation step that has been challenging so far. For example, in a heterogeneous cell population, separating cells based on their size differences within the droplet, followed by droplet splitting, will result in one daughter droplet having larger cells within it and the other daughter droplet having smaller cells within it.

Some researchers have demonstrated in-droplet cell manipulation using magnetic beads for various applications such as drug analysis, immunoassay, and molecular detection has previously been demonstrated. However, this requires labelling of cells with magnetic beads, an extra step, and cannot be used as a general strategy when such labeling is not possible or not desired. Label-free methods for cell manipulation inside droplets are most desirable, and have been achieved in two different ways so far. The first method relies on hydrodynamic focusing coupled to gravity-based sedimentation, where particles were focused to either one side of a droplet or two sides of a droplet. However hydrodynamic focusing typically requires a relatively complex microstructure design and is challenging to characterize in general as a slight change in condition will result in no movement of cells within a given droplet. In addition, as cells within droplets are concentrated to both sides of the droplet, obtaining a single daughter droplet with highly concentrated cells is not possible, or requires duplicate unit operators downstream or an additional step of merging those two daughter droplets into a single droplet. Another method is based on acoustophoretic force, which was successfully applied to focus cells to the middle of a droplet. The acoustophoresis force accumulated cells inside a droplet to the center acoustic pressure node, and following a three-outlet droplet splitting junction, resulted in a center daughter droplet that had high concentration of cells, and two side droplets with minimum number of cells or no cells. However, the maximum achievable cell recovery rate was only 89%. More importantly, acoustophoresis devices using bulk acoustic wave require the microfluidic device to be made from hard substrates such as glass and silicon, as commonly used microfluidic device materials such as polydimethylsiloxane (PDMS) do not support acoustophoresis due to acoustic wave absorption in PDMS, making device fabrication more complicated and limiting its applications. Acoustophoresis devices using surface acoustic wave require special substrates that can be used to generate the surface acoustic wave as well as support such waves, and are generally costly. It also requires a piezoelectric power amplifier to generate acoustic wave that drives acoustophoresis.

Dielectrophoresis (DEP) is an electric field-based and label-free method that has been extensively utilized in material manipulation in free-flow microfluidics. Materials, even in heterogeneous populations can be selectively influenced by the DEP force depending on their intrinsic dielectric properties and their surrounding solutions, as well as the specific frequency applied. Although DEP-based manipulation of cells in droplets has been demonstrated in digital microfluidics (electrowetting-on-dielectric (EWOD) methods), reducing the volume of daughter droplets are limited in such a method. More importantly, there are significant differences in applications that can be achieved in EWOD-based droplet microfluidics and free-flow based droplet microfluidics, the latter having orders of magnitude higher throughput and many other advantages.

It is shown herein, that cells within continuously moving droplets can be concentrated to one side of a droplet using negative DEP (nDEP) force, and upon droplet splitting, be highly enriched in one of the daughter droplets. Although a DEP-based electrowetting-on-dielectric (EWOD) method has been successfully shown previously in controlling target cells inside droplets based on their dielectric properties, the droplet manipulation method is a non-continuous method, thus lacking the high-throughput capability. Furthermore, in general, the EWOD method requires complicated fabrication and setup, and not compatible with free-flow droplet microfluidics.

Considering the foregoing, there exist a need for an apparatus and method to continuously separate or concentrate cells in a droplet-based microfluidic system. An apparatus that can be simply fabricated and simply operated is also be desirable.

SUMMARY

An embodiment of the disclosure is a device for concentrating materials comprising a material concentration microchannel coupled with one or more pairs electrodes; a droplet splitting part connecting to the concentration microchannel; wherein voltage on the one or more pairs of electrodes creates an electric field across the concentration microchannel to generate a DEP force on the material in a droplet such that the material is concentrated in the droplet; wherein the droplet splitting part has at least two microchannels to separate the droplet into at least two daughter droplets having a different material concentration or different properties. In an embodiment, a cross section shape of the concentration microchannel is rectangular and the width and the height of the concentration microchannel is between 1 μm to 10 mm. In an embodiment, the concentration microchannel is between 20 μm to 2 mm wide and between 10 μm and 1 mm high. In an embodiment, the one or more pairs of electrodes are planar electrodes with a gap therebetween at the bottom of the concentration microchannel. In an embodiment, the gap is placed at an angle to the flow direction of the droplet. In an embodiment, the angle ranges from 1 degree to 90 degrees. In an embodiment, the angle is 1.37 degrees. In an embodiment, the one or more pairs of electrodes cover the whole concentration microchannel except for two parallel electrode gaps. In an embodiment, the one or more pair of electrodes are replaced by interdigitated multiple pairs of electrodes. In an embodiment, the concentration microchannel is made of PDMS. In an embodiment, the one or more pairs of electrodes are made of Cr/Au and located on a glass substrate. In an embodiment, the one or more pairs of electrodes are covered by a dielectric layer. In an embodiment, the inner surface of the concentration microchannel comprises a hydrophobic layer. In an embodiment, the device further comprises an encapsulated droplet generation module.

An embodiment of the disclosure is a device for concentrating at least two kinds of materials inside a droplet comprising a material concentration microchannel coupled with at least two pairs of electrodes; a droplet splitting part connecting to the concentration microchannel; wherein a voltage at a frequency on one of the at least two pairs of electrodes creates electric field across the concentration microchannel to generate a pDEP force on one kind of material in a droplet such that the one kind of particles or cells are concentrated in one place of the droplet; wherein another voltage at another frequency on another of the at least two pairs of electrodes creates electric field across the concentration microchannel to generate a nDEP force on a different kind of material in the droplet such that the different kind of material are concentrated in a different place of the droplet; and wherein the droplet splitting part has at least two microchannels to separate the droplet into at least two daughter droplets having different kinds of material.

An embodiment of the disclosure is a method for separation or concentration of materials inside a droplet, comprising driving the droplet to flow through a concentration microchannel; utilizing a positive or negative dielectrophoretic force to move materials in the droplet to one side of the droplet in the concentration microchannel by applying voltage on one or more pairs of electrodes coupled to the concentration microchannel; creating at least two daughter droplets from the droplet in a splitting microchannel, wherein one daughter droplet comprises a majority of materials and the other at least one daughter droplet comprises a minority of the materials. In an embodiment, a recovery rate of the materials can be changed by adjusting the applied voltage on the one or more pairs of electrodes. In an embodiment, a recovery rate of the materials can be changed by adjusting a flow rate of the droplets. In an embodiment, a recovery rate of the materials can be changed by adjusting droplet splitting channel ratio. In an embodiment, the method further comprises merging the one daughter droplet with another droplet comprising a desired reagent, wherein the result is concentrated materials for resuspension in a desired media, resulting in solution exchange.

An embodiment of the disclosure is a device for washing materials and replacing a solution in which the materials are suspended in a desired solution comprising a materials concentration microchannel coupled with one or more pairs of electrodes; a droplet splitting part connecting to the material concentration microchannel; wherein the droplet splitting part has at least two microchannels to separate the droplet into at least two daughter droplets having a different material concentration; wherein voltage on the one or more pairs of electrodes creates an electric field across the material concentration microchannel to generate a DEP force on the material in a droplet such that the material are concentrated to one side or both sides of the droplet; and a droplet merging part where a second droplet comes in that contains a desired solution; wherein the droplet merging part daughter droplets that contain the desired materials and the droplets that contain the desired solution get merged together to achieve replacement of the solution. The disclosure addresses the deficiencies in the prior art by using a dielectrophoretic in-droplet cell concentrator to achieve continuous separation or concentration/dilution of cells or microparticles.

An embodiment of the disclosure is a device for concentrating particles or cells comprising a concentration microchannel coupled with a pair of electrodes, and a droplet splitting part connecting to the concentration microchannel. Voltage on the pair of electrodes creates an electric field across the concentration microchannel to generate a DEP force on the particles or cells in a droplet such that the particles or cells are concentrated in the droplet. The droplet splitting part has at least two microchannels to separate the droplet into at least two daughter droplets having different particle or cell concentration.

The cross-sectional shape of the concentration microchannel is rectangular, the width and the height of the concentration microchannel can be changed from 1 μm to 1 mm depending on the size of droplets, particles, and cells. In one embodiment, the width and the height of the concentration microchannel are 200 μm and 20 μm, respectively.

The electrodes are planar electrodes with a gap therebetween at the bottom of the concentration microchannel to generate the DEP force. 3D electrode can be embedded at the side of the concentration microchannel. In one embodiment, the electrodes cover the whole concentration microchannel except for the electrode gap. In one embodiment, the pair of electrodes are replaced by interdigitated multiple pairs of electrodes. In one embodiment, the pair of electrodes are positioned at the top and bottom of the channel.

The gap is placed at an angle to the flow direction of the droplet. The angle can be changed from 1 degree to 90 degree depending on the size of particles and cells and length of the concentration microchannel. In one embodiment, the angle is 1.37°.

In one embodiment, the concentration microchannel is made of polydimethylsiloxane (PDMS) and the electrodes are made of Cr/Au and located on a glass substrate. In one embodiment, the glass substrate is borofloat glass. In one embodiment, the pair of electrodes are covered by a dielectric layer.

In one embodiment, the inner surface of the concentration microchannel comprises a hydrophobic layer.

In one embodiment, the device further comprises a cell or particle-encapsulated droplet generation module, the device can further comprise droplet re-merging module.

In one embodiment, the encapsulated droplet generation can include a T-junction or a flow focusing structure coupled with the input port of the concentration microchannel, the droplet splitting part is a Y-shaped (or T-shaped) microchannel structure.

In another aspect, the disclosure relates to a method for separation or concentration of particles and cells inside a droplet, comprising driving the droplet to flow through a concentration microchannel; utilizing a positive or negative dielectrophoretic force to move cells or particles in the droplet to one side of the droplet in the concentration microchannel by applying voltage on a pair of electrodes coupled to the concentration microchannel; creating at least two daughter droplets from the droplet in a splitting microchannel, wherein one daughter droplet comprises a majority of particles or cells and the other at least one daughter droplet comprises a minority of the particles or cells or one daughter droplet comprises one kind of cells and the other daughter droplet comprises the other kind of cells.

In one embodiment, the method further includes generating droplets that contain the particles or cells and injecting the droplets that contain the particles or cells into the concentration microchannel.

In one embodiment, the method further includes merging the said one daughter droplet with another droplet containing a desired reagent, thus resulting in concentrated particles or cells to be re-suspended in a desired media, resulting in solution exchange.

In some embodiments, the recovery rate of the particles or cells can be changed by adjusting the applied voltage on the electrodes or by adjusting the flow rate.

In one embodiment, the recovery rate of the particles or cells can be changed by adjusting the width ratios of the droplet splitting channels.

This disclosure can be utilized as an important part of a high-throughput droplet microfluidics system, enabling a simple cell washing step or a cell concentration adjustment step or a cell separation step, as well as media exchanging step. These are one of the last remaining fundamental operations in droplet microfluidics that have not been achievable previously, or achieved with limitations, thus the application is extremely broad and diverse.

Droplet manipulation based on the microfluidic technologies are being developed for extremely broad applications ranging from immuno-assays for discovering cell secreting antigen-specific antibodies, high-throughput drug screening, high-throughput cell phenotyping, and point of care diagnosis platform. Since in-droplet cell concentration function is essential to further manipulate cells inside droplets, it can be one part of an integrated droplet manipulation microfluidic system.

This disclosure can replace the currently developed in-droplet cell concentration technologies such as the one using acoustophoretic force, which has limitations in functions, throughput, efficiency, fabrication process, and instrument cost. This invented technology can readily be adopted and integrated in enormous ranges of droplet manipulation applications.

The foregoing has outlined rather broadly the features of the present disclosure in order that the detailed description that follows may be better understood. Additional features and advantages of the disclosure will be described hereinafter, which form the subject of the claims.

BRIEF DESCRIPTION OF THE DRAWINGS

In order that the way the above-recited and other enhancements and objects of the disclosure are obtained, a more particular description of the disclosure briefly described above will be rendered by reference to specific embodiments thereof which are illustrated in the appended drawings. Understanding that these drawings depict only typical embodiments of the disclosure and are therefore not to be considered limiting of its scope, the disclosure will be described with additional specificity and detail using the accompanying drawings in which.

Although these drawing shows examples of using particles and cells, it can be broadly utilized for in-droplet manipulation of any materials that can be influenced by dielectrophoretic force. Like elements in the various figures are denoted by like reference numerals for consistency.

DETAILED DESCRIPTION

Figure 1:
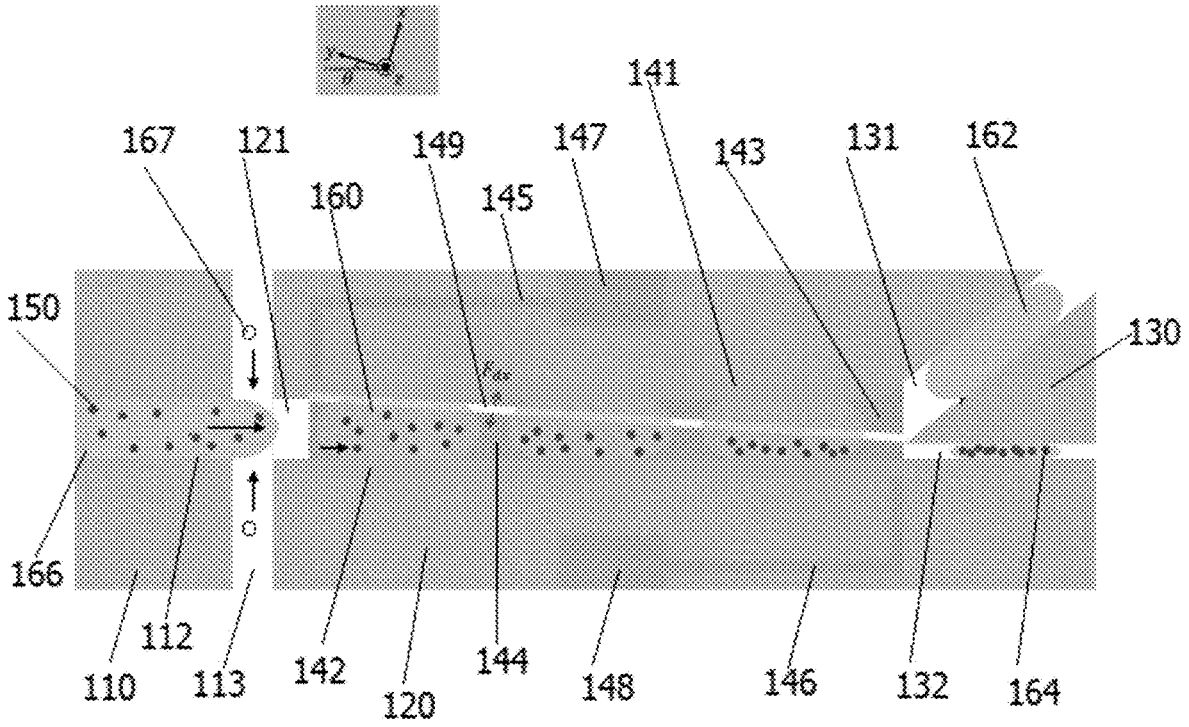
FIG. 1 depicts a schematic showing the working principle of cell concentration inside droplets based on dielectrophoretic (DEP) force.

The particulars shown herein are by way of example and for purposes of illustrative discussion of the preferred embodiments of the present disclosure only and are presented in the cause of providing what is believed to be the most useful and readily understood description of the principles and conceptual aspects of various embodiments of the disclosure. In this regard, no attempt is made to show structural details of the disclosure in more detail than is necessary for the fundamental understanding of the disclosure, the description taken with the drawings making apparent to those skilled in the art how the several forms of the disclosure may be embodied in practice.

The following definitions and explanations are meant and intended to be controlling in any future construction unless clearly and unambiguously modified in the following examples or when application of the meaning renders any construction meaningless or essentially meaningless. In cases where the construction of the term would render it meaningless or essentially meaningless, the definition should be taken from Webster's Dictionary 3rd Edition.

The terms "up" and "down"; "upper" and "lower"; "above" and "below" and other like terms as used herein refer to relative positions to one another and are not intended to denote a particular direction or spatial orientation. The term "particle" is used to represent broad ranges of materials, but not limited to, cells, microparticles, and other materials of interest in droplet microfluidic applications.

Dielectrophoresis (DEP) is the motion of materials, such as particles toward or away from regions of high electric field intensity. When an external electric field is applied to a system consisting of a particle suspended in a fluid medium, charges are induced to appear at the particle-fluid interface to confer on this polarized particle the properties of an electric dipole. The electrostatic potential of a polarizable particle is minimized in regions of highest electric field intensity. If the particles are immersed in a polarizable fluid, the electrostatic energy of the system is minimized by placing the most polarizable component in the high-field regions. If the particle is more polarizable than the fluid, it will be impelled toward a region of high field intensity (positive dielectrophoresis) or otherwise toward a region of lower field intensity (negative dielectrophoresis). The polarization of particles occurs by a variety of mechanisms having characteristic relaxation times. The frequency variation of the net polarization is a means of obtaining information about or manipulating particles on the basis of their internal and external physical structure. In DEP, the force on a particle and its surrounding medium is proportional to the gradient of the field intensity and is independent of the direction of the electric field. This is in contrast to electrophoresis, the field-induced motion of charged particles, wherein the direction of the force on a particle is dependent upon the sign of the charge and the direction of the field.

For a particle to experience either positive or negative DEP it must be subject to a spatially non-uniform electric field. Conventionally, these inhomogeneous fields are produced using various electrode geometries.

A dielectrophoresis-based in-droplet cell concentrator followed by asymmetric droplet splitting that results in a daughter droplet with highly concentrated cell or different populations of cells is disclosed. The technology utilizes dielectrophoresis to gradually focus cells within a droplet to one side of the droplet, followed by asymmetric droplet splitting using a Y-junction. The volume of one daughter droplet was reduced up to 84% compared with the mother daughter droplet. When testing with cells, the recovery rates of *Chlamydomonas reinhardtii* cells up to 98% inside the daughter droplet were achieved. When tested with two different populations of cells, in-droplet cell separation was also successfully achieved using a combination of positive dielectrophoresis and negative dielectrophoresis, where one daughter droplet contained one types of cells and another daughter droplet contained the other type of cells. This technology adds new capabilities to droplet microfluidics operation, such as adjusting concentrations of cells in droplets, separating cells of different properties from inside droplets, cell washing, and solution exchange, common in conventional bioassays but so far difficult to achieve in droplet format.

In an embodiment, the DEP-based in-droplet cell concentrator disclosed herein consists of three functional parts: cell-encapsulated droplet generation part 110, in-droplet cell concentrator 120 that has a pair of angled electrodes 141, 142, and a droplet splitting part 130. FIG. 1. The droplet generation can be conducted by any method or device that is well known to people ordinary skilled in the art. In one embodiment, a standard T-junction droplet generator is used. The T-junction droplet generator includes a cell suspending injection microchannel 112 and an oil injection microchannel 113, where the widths of the oil and cell suspending injection microchannels are 70 and 150 μm, respectively. There is a cell suspending solution 166 which contains particles or cells 150 in the microchannel 112 and oil 167 in the microchannel 113. Flow rates for each solution (the arrows represent the flow direction of the solutions) were controlled to form 100 μm diameter encapsulated droplets 160 that encapsulated particles or cells 150. The encapsulated droplets 160 are pushed into a concentration microchannel 121 of the in-droplet cell concentrator 120. The cross section of the concentration microchannel 121 is rectangular with the width and the height being 200 μm and 20 respectively, meaning that the droplets 160 flowing through this channel will be squeezed and elongated, filling almost the entire cross-section of the microchannel 121. The relatively shallow height was used to restrict the maximum levitation height of the cells (z-direction) within a droplet, and thus maximize the DEP force applied to cells. In an embodiment, the pair of angled electrodes 141, 142 include two planar electrodes 143, 144 at the bottom of the microfluidic channel forming a 20 μm gap 149 therebetween and are placed at an angle (θ) of 1.37° to the flow direction of the microchannel. The pair of angled electrodes 141, 142 further include connecting terminals 147, 148 respectively to couple to power supply (not shown) and connection wires 145, 146 to connect connecting terminals 147, 148 and electrodes 143, 144 respectively. A pair of electrodes 143, 144 are used to create a non-uniform electric field to generate the DEP force. Since the electric charges on two planar electrodes are mostly concentrated to the edges of the electrode 143 and 144 facing each other, the electric field is strongest around the two edges of the electrodes. The time-averaged x-directional DEP force, $F_{dx}$ in FIG. 1, is shown in Equation 1.

$$F_{dx} = 2\pi\varepsilon_m r_c^3 Re[f_{CM}]\frac{\partial|\vec{E}|^2}{\partial x} \quad (1)$$

Figure 2:
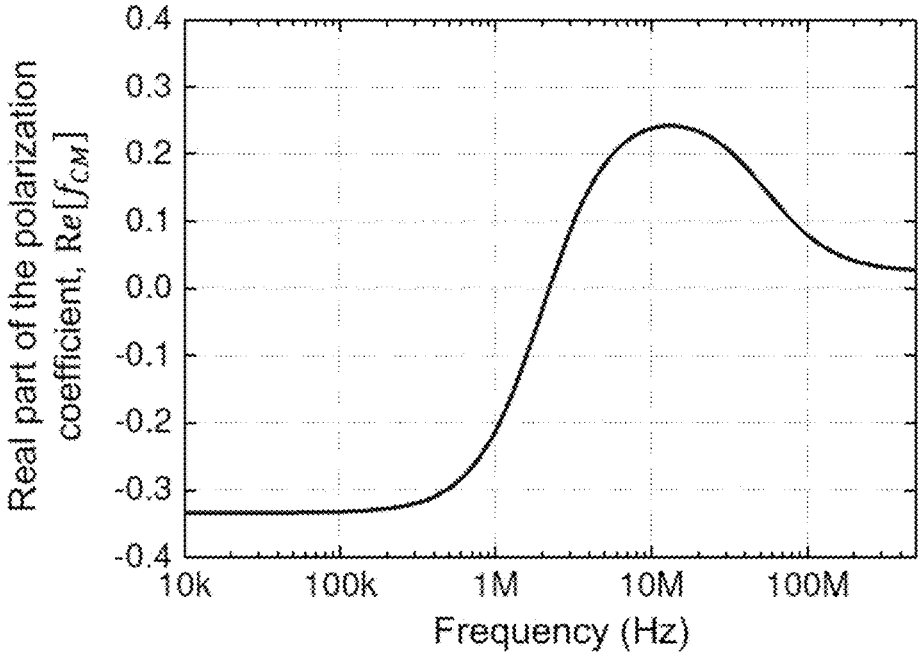
FIG. 2 shows the calculated real part of the polarization coefficient ($Re[f_{CM}]$) of microalgae *Chlamydomonas reinhardtii* strain CC-406 cells, suspended in a 0.1 S $m^{-1}$ TAP media after three days of cultivation.

In Equation 1, the x-direction is perpendicular to the edge of the electrode, $\varepsilon_m$ is the permittivity of the solution, r is the cell radius, $f_{CM}$ is the Clausius-Mossotti factor, and E is the x-directional root mean square magnitude of the electric field. Per Equation 1, the magnitude of the DEP force ($F_{DEP}$) acting on the cell is determined by the applied voltage (related to the factor $E^2$), the real part of the Clausius-Mossotti factor ($Re[f_{CM}]$), the cell size (r), and the dielectric properties of the cell and the solution. FIG. 2 shows the calculated real part of the polarization coefficient ($f_{CM}$) of CC-406 cells, suspended in a 0.1 S m−1 TAP media after three days of cultivation. The measured average radius of CC-406 was 4.3±0.62 μm and was used in the calculation. The capacitance of the cell membrane and the conductivity/permittivity of plasma used for this calculation were 2 mF m−2, 0.5 S m−1, and 100 F m−2, respectively. When the applied electric frequency is less than 500 kHz, the calculated real part of the Clausius-Mossotti factor of polystyrene particles or cells is about −0.33. This means that the polarity of the DEP force acting on the cells or particles 150 is negative at frequency ranges less than 500 kHz, which will cause an upward and repelling force to the cells from the electrodes. By placing the parallel electrode at an angle against the microfluidic channel, cells can be gradually pushed to one side of the microfluidic channel as the cells flow downstream. This cell manipulation scheme is used in the present in-droplet cell concentrator. At the beginning of the cell concentration microchannel 121, the nDEP force ($F_{dx}$) is strongest at the upper sidewall of the cell concentration microchannel, that position is closest to the electrode gap 149. The position of the electrode gap 149, where $F_{dx}$ is the strongest, gradually moves towards the opposite sidewall (lower sidewall of the cell concentration microchannel) since the electrodes are placed at an angle to the flow direction. As cells are repelled downward from the edge of the electrode 143, this results in cells to be steadily concentrated into the lower side of the droplet. Once all or most cells inside the droplet are concentrated to one side of the droplet 160, the droplet 160 reaches the downstream droplet splitting part 130, which includes two asymmetric droplet splitting microchannels 131 and 132 where it divides into two daughter droplets. The daughter droplet 162 in the upper microchannel is nearly empty and the daughter droplet 164 (in the lower microchannel 132) has all or most of the cells. Using this configuration, the DEP in-droplet cell concentrator can be used both for microparticles and cells.

Figure 3:
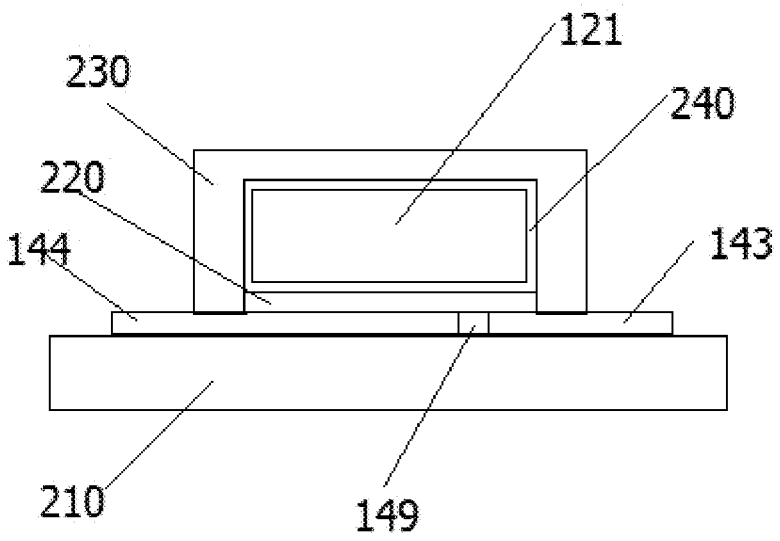
FIG. 3 shows a cross-sectional view of a microchannel.

FIG. 3 is a cross-sectional view of a cell suspending injection microchannel 112. In an embodiment, the DEP in-droplet cell concentrator was composed of a polydimethylsiloxane (PDMS) microchannel wall 230 and a 0.7 mm thick borofloat glass substrate 210 with electrode patterns. The planar electrodes 143, 144 were made of Cr/Au (20/100 nm) evaporated and patterned on the glass substrate. A hydrophobic coating solution is injected into the microchannel for 2 min and then, dried it out at room temperature to render the microchannel surface and metal surface forming a hydrophobic layer 240. Other methods to form the hydrophobic property of the metal layer is that it was insulated by a 30 nm (the height can vary to achieve best efficiency depending on the thickness of the metal layer) dielectric layer 220 (such as $SiO_2$ or SiN). Once the glass substrate with the planar electrode and the PDMS replica were treated with oxygen plasma for 2 minutes, they were aligned and bonded, creating the device.

Figure 4:
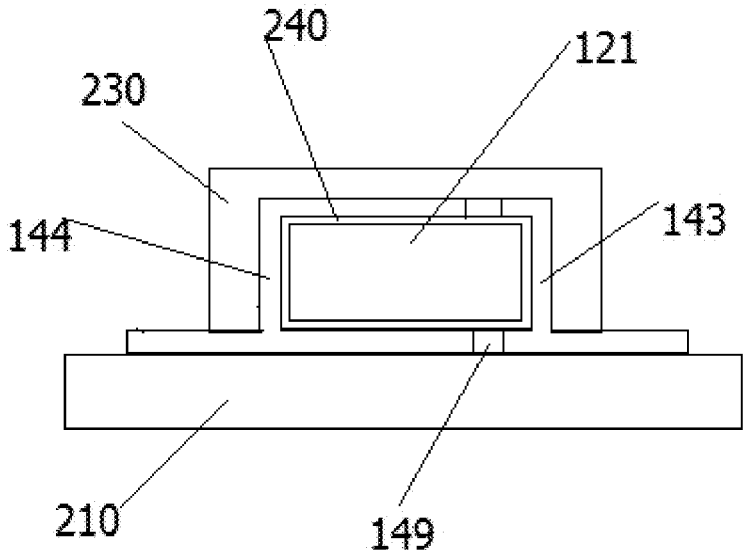
FIG. 4 shows a cross-sectional view of a microchannel with electrodes covering the whole concentration microchannel except for the electrode gap.

In one embodiment, the electrodes cover the whole concentration microchannel except for the electrode gap. FIG. 4. In this case, the electrodes 143, 144 cover the inner surface of the concentration microchannel 121 except for the electrode gap 149 at the bottom and an electrode gap 159 at the top section of the concentration microchannel 121. The electrode gaps 149 and 159 are parallel and have an angle to the flow direction of the microchannel 121. The extended electrodes increase the DEP force acting on the particles such that the efficiency will be improved. The concentration microchannel 121 can also include a hydrophobic layer 240 or a dielectric layer (not shown in FIG. 4).

Figure 5:
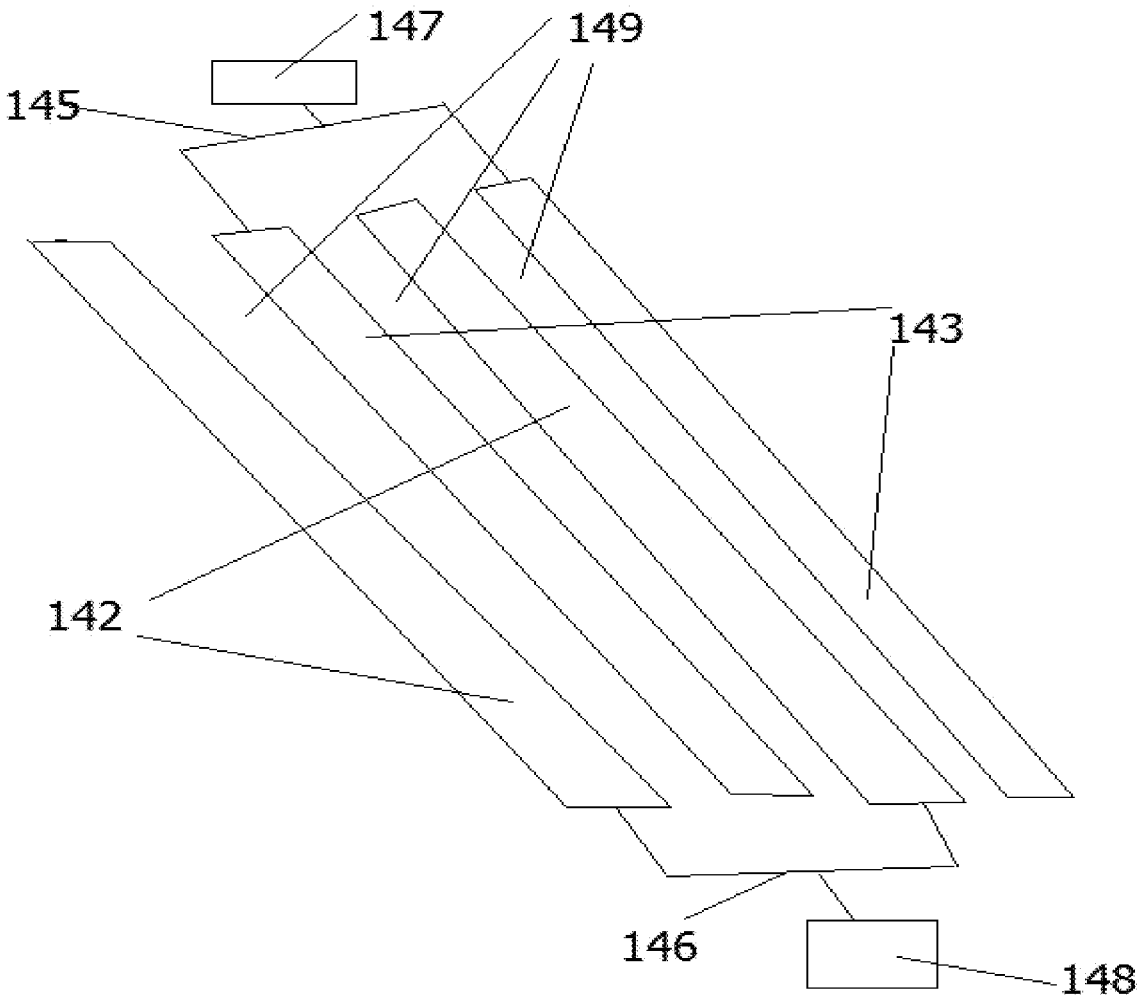
FIG. 5 depicts a schematic showing interdigitated multiple pairs of electrodes.

In one embodiment, the electrodes include interdigitated multiple pairs of electrodes. Referring to FIG. 5, the electrodes include two pairs of interdigitated electrodes 142 and 143. The two electrodes 142 are connected to connecting terminal 148 through wire 146 and the two electrodes 143 are connected to connecting terminal 147 through wire 145, such that three gaps 149 are created between the electrodes which will increase the DEP force acting on the particles.

In one embodiment, to maintain stable droplets, a hydrophilic gold surface is changed to have hydrophobic properties. A metal coating solution (e.g., precious metal treatment, Aculon, San Diego, Calif.) was injected into the microchannel for 2 min and then dried at room temperature, followed by flowing another solution (e.g., Aquapel™, Pittsburgh Glass Works, LLC, Pittsburgh, Pa.) to treat the rest of the microchannel surface to also be hydrophobic. A voltage of 500 kHz, 10-20 V peak-to-peak sinusoidal signal was generated from a function generator (DG4102, Rigol Technologies Inc.). FC-40 was used as the carrier oil and low conductivity (LC) media with a conductivity adjusted to 0.1 S $m^{-1}$ was used to simulate the condition of cell culture in droplet. Polystyrene (PS) particles (diameter: 5 μm, Duke Scientific) suspended in the LC media were initially used to demonstrate the concept as well as to characterize the conditions needed for in-droplet cell concentration by adjusting the applied voltage, flow rate, and droplet splitting microchannel width ratio.

Figure 6:
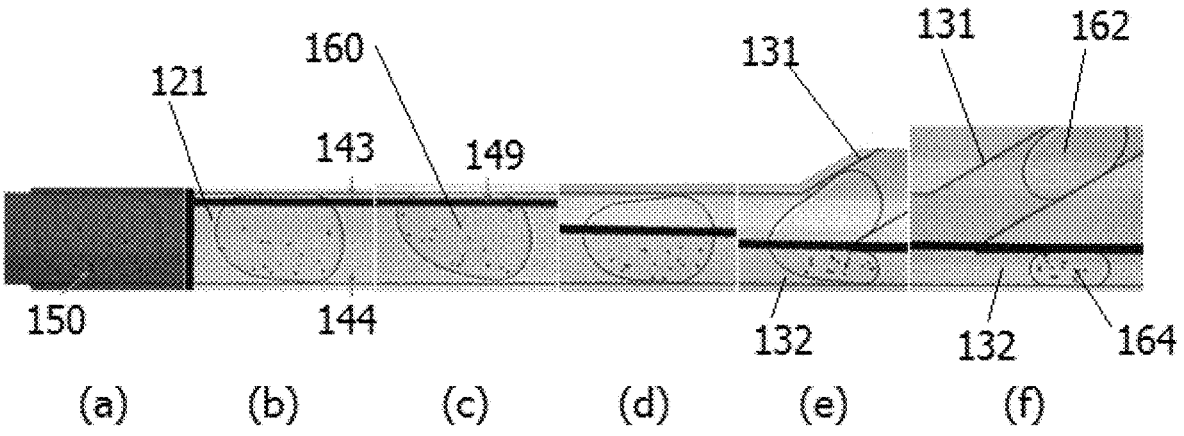
FIG. 6 depicts a microscopic image of particle concentration inside a flowing droplet, from upstream (left) to downstream (right) of the microchannel that has the angled pair of DEP electrodes, wherein (a) Particle-encapsulated droplets were continuously generated and flowed into the particle or particle or cell-concentration channel. (b)-(e) Particles inside a droplet (number of particles: 16) were repelled from the edge of the electrodes by generated negative DEP force and gradually focused into one side of the droplet. (f) Daughter droplet with all the accumulated particles was formed by a two-branch asymmetric droplet splitting microchannel (scale bar: 200 μm)

In a first application, cells or particles inside a droplet can be concentrated within the droplet. FIG. 6 shows microscopic images showing how particles inside a droplet concentrate towards the lower part of the droplet as it flows from upstream (left) to downstream (right) inside the DEP microchannel. After particle-encapsulated droplet generation having randomly positioned particles within (FIG. 6*a*), the droplet entered the particle or cell-concentration microchannel 121 having a pair of angled DEP electrodes. FIG. 6*b* shows that electrode 143 is placed about 5 μm into the microchannel from the top and electrode 144 covers the rest of the microchannel, with the dark line showing the electrode gap 149 of 20 μm. When the particles 150 are transported to the droplet rear by the flow field generated inside the droplet 160, the particles are dragged by the droplet rear wall and moved up or down to the side of droplet depending on their initial position. Since the velocity of the particles is relatively accelerated where the particles were passing through the side of the droplet close to the microchannel wall, the DEP force acting on the particles is comparatively decreased by increasing the drag force. Thus, even though the DEP force is generated from the electrode 143 in the beginning region of the particle or cell-concentration channel, it is insufficient to repel the particle to the upper electrode 143. When the velocity of the particles was reduced again where the particles are located near the middle of the droplet front, the particles are gradually pushed towards the bottom side of the droplet as they are repelled by the edge of the electrode 144, confining all particles to below the gap 149 (FIG. 6*c-d*). Even though DEP force towards the upper sidewall of the channel was also generated from the electrode 143, since all particles were already positioned below the gap 149, the upward force did not influence the particles. This droplet is then split into two daughter droplets using an asymmetric branched microchannel (FIG. 6*e*). The lower microchannel width ratio to the main microchannel width is 0.35 (70 and 200 μm, respectively), resulting in volumetric ratio of about 0.25 between the two daughter droplets. After droplet splitting (FIG. 6*f*), daughter droplet 164 contains all the PS particles while the daughter droplet 162 is empty. During the particle concentration step, the aqueous droplet itself can also be influenced by positive DEP force due to the dielectric property differences between the culture media inside the droplet and the surrounding carrier oil, which means that the real part of the Clausius-Mossotti factor is always a positive factor regardless of the applied frequency. Therefore, the shape of the droplet is somewhat distorted and dragged around the electrode gap where the electric field is strongest. However, this phenomenon did not affect the particle accumulation and droplet splitting steps.

Figure 7:
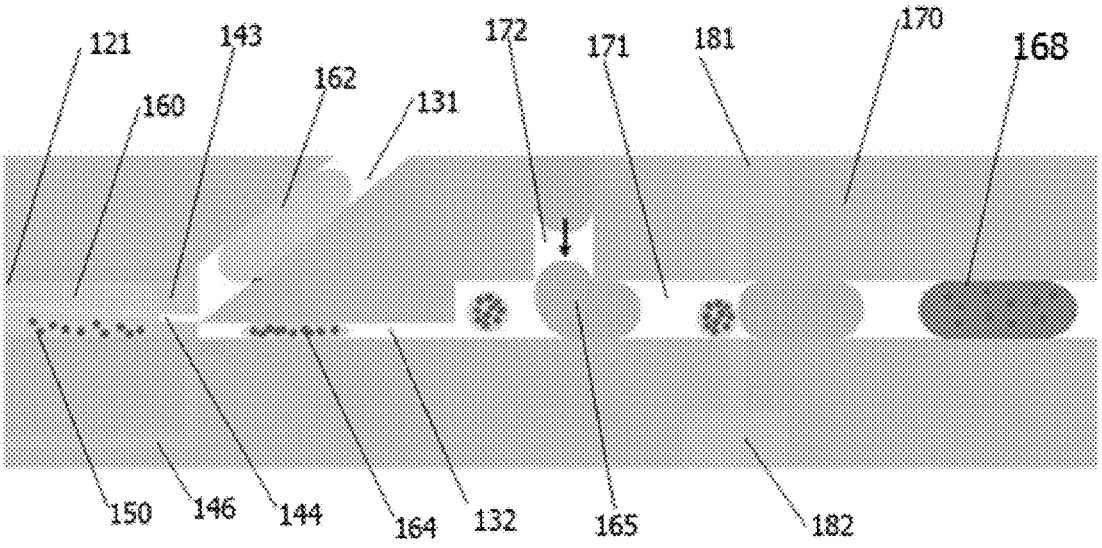
FIG. 7 depicts a schematic showing the in-droplet cell concentrator together with the cell merging processes to achieve in-droplet solution exchange so that cells are suspended in a desired reagent.

In a second application, referring to FIG. 7, the daughter droplet 164 that has all the cells will be merged with another droplet 165 generated through a second droplet generator 170 and containing different reagent. The resulting droplet will be where cells are now suspended in a different reagent, demonstrating a solution exchange in droplet format. The second droplet generator 170 include microchannels 171 and 172, and a pair of merging electrodes 181, 182 coupled to the microchannel 171. The daughter droplet 164 moves downstream from microchannel 132 to microchannel 171. The droplet 165 moves into microchannel 171 through microchannel 172. The droplets 164 and 165 are merged into a droplet 168 when they move through the merging electrodes 181, 182.

Figure 8:
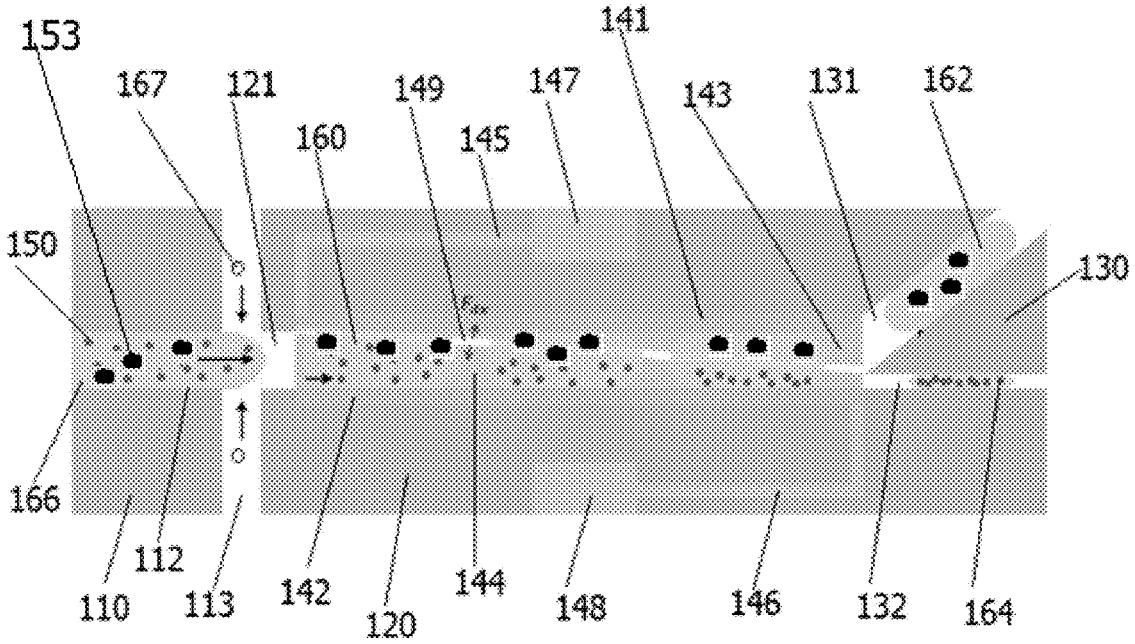
FIG. 8 depicts a schematic showing separation of two kinds of cells using the DEP in-droplet cell concentrator followed by droplet splitting so that one daughter droplet contains one kind of cells and the other daughter droplet contains the other kind of cells.

In a third application, referring to FIG. 8, cells or particles of different sizes or different dielectric properties inside a droplet can be separated within the droplet, followed by splitting the mother droplet into two daughter droplets. This in-droplet cell separation scheme allows a heterogeneous mixture of cells/particles within a given droplet to be separated out following a particular in-droplet assay. As an example, in the case where the initial mother droplet 166 contains cells of two different sizes and/or properties (e.g., two different types of cells 150 and 153), by adjusting the amplitude/frequency of the applied voltage and the angle of the electrodes (as well as electrode-electrode distances), the DEP force and polarity to large cells (as an example macrophages) 153 and small cells (as an example *Salmonella* cells) 150 inside a droplet 166 will be different, thus resulting in gradual accumulation of one type of cells into one side of the droplet. Consequently, the large target cells or particles could be separated from a heterogeneous mixture and enriched in the daughter droplet 164. The same principle can be applied to cells of different dielectrophoretic properties, such as white blood cells and red blood cells.

In a fourth application, in addition to enabling solution exchange, the conventional centrifugation step also allows the concentration of particles or cells to be adjusted in the desired solution. This is typically achieved by first centrifuging the samples to move all cells/particles to the bottom of a centrifuge tube, removing all supernatant, followed by adding the appropriate volume of desired solution to the pelletized cells/particles. Depending on the volume of the solution added, the concentration of cells/particles can be adjusted. The in-droplet cell or particle concentration function allows not only cell or particle concentration inside a droplet, but also adjusting the concentration of cells/particles in a droplet.

EXAMPLES

To demonstrate the feasibility of the DEP in-droplet cell concentrator, initially polystyrene (PS) particles (diameter 5 μm) were used, followed by using live microorganisms (*Chlamydomonas reinhardtii* CC406 cells, which is a microalgal strain, as well as *Salmonella*) and live mammalian cells (macrophage). The conductivity of a normal culture media (tris-acetate-phosphate, TAP) was 0.1 S/m after three days of cell cultivation. The particles were suspended in a low conductivity (LC) solution where the conductivity was adjusted to 0.1 S/m.

Example 1

Figure 9:
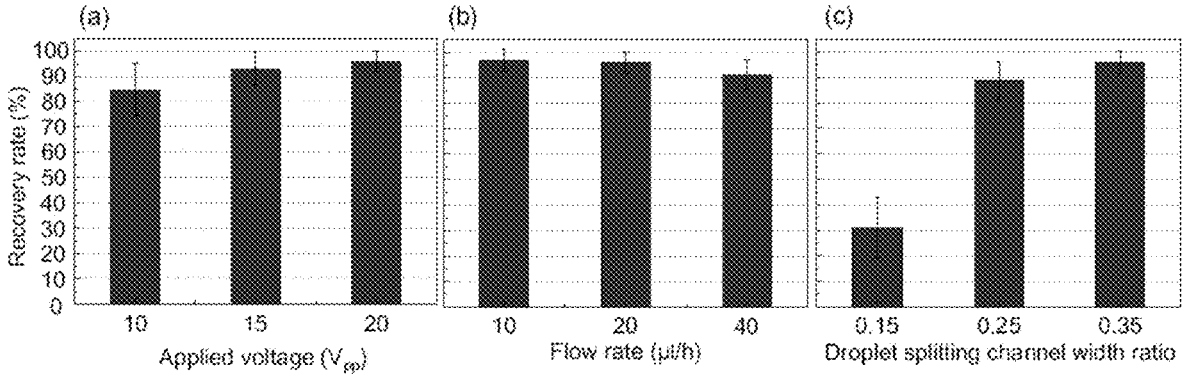
FIG. 9 shows the recovery rate of the PS particles concentrated in the daughter droplet under different (a) applied voltages, (b) flow rates, and (c) droplet splitting channel width ratios. Error bars represent one standard deviation calculated from over 100 data sets.
Figure 10:
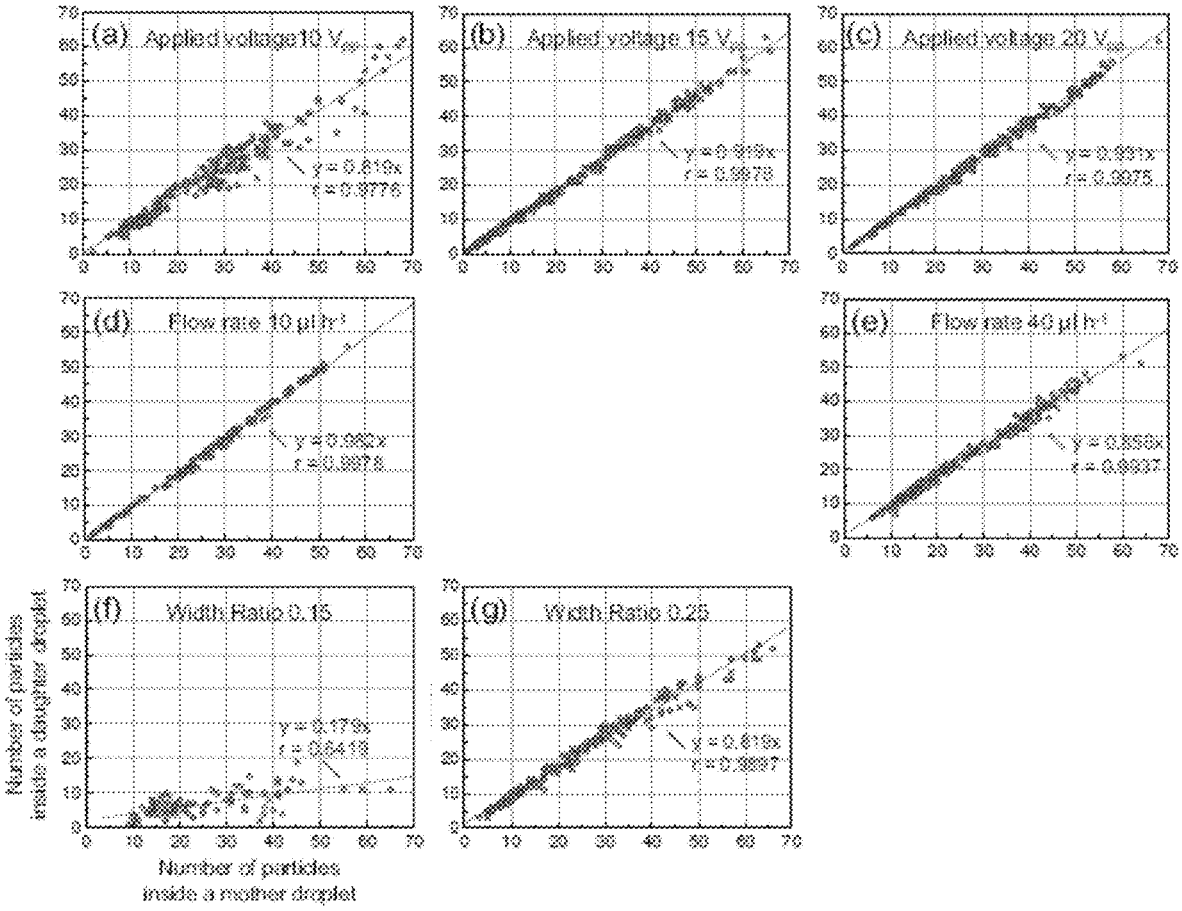
FIG. 10 shows regression analysis of the concentration-dependent recovery rate for varying particle concentrations inside the droplet, depending on (a-c) the applied voltage at 20 μl $h^{-1}$ total flow rate and 0.35 droplet splitting microchannel ratio, (d-e) the total flow rate at the applied voltage of 20 $V_{pp}$ and 0.35 droplet splitting microchannel ratio, and (f-g) the droplet splitting microchannel ratio at the applied voltage of 20 $V_{pp}$ and 20 μl $h^{-1}$ total flow rate.

Referring to FIG. 9, the recovery rates in response to the applied voltage, flow rate, and droplet splitting microchannel width ratio were characterized using PS particles. The rate was calculated by comparing the total number of particles inside the initial mother droplet with the number of the accumulated particles inside the daughter droplet 164. The applied voltage, which is related to the electrical field applied, is one of the dominant factors of the nDEP force acting on the particles. As shown in FIG. 9(*a*), to check the effect of the applied voltage on the recovery rate, the total flow rate was set constant to 20 μl $h^{-1}$ (about 20 droplets flow by per minute), and the flow rate ratio of carrier oil to aqueous phase was set to 2:3. The droplet splitting microchannel width ratio (lower splitting microchannel width/main microchannel width) was 0.35. The repelled distances of the PS particles from the edge of the electrode 144 were 15±2, 23±1, and 28±2 μm when 10, 15, and 20 Vpp were applied, respectively. As such, a higher recovery rate was observed when a higher voltage was applied, with recovery rates being 85±10, 93±7, and 96±4% under the applied voltages of 10, 15, and 20 $V_{pp}$, respectively. As the restricted space under the electrode 144 was reduced, some particles were pushed in the opposite direction since the circular flow field acting on the particles within the droplet was stronger than DEP force. To test the effect of different total flow rates, a fixed voltage of 20 $V_{pp}$ was applied using the same droplet splitting channel having a channel widths ratio of 0.35 (channel width of the bottom splitting channel/main channel). As shown in FIG. 9*b*, the recovery rate achieved was 97±4, 93±7, and 91±6% when the total flow rate was 10, 20, and 40 μl (corresponding to 10 and 40 droplets per minute), respectively. Despite the increasing total flow rate, over 90% of particles inside the mother droplet could be concentrated into the daughter droplet 164. To further reduce the volume of the daughter droplet 164, which will give more concentrated particles with less pre-existing media left (i.e., more complete washing or higher enrichment), the effect of different droplet splitting microchannel ratios was also investigated. As shown in FIG. 9*c*, the ratio of the daughter droplet 164 volume compared to the mother droplet volume decreased from 25±1, 16±2, and 13±1% when the ratio of the lower splitting channel width decreased from 0.35 to 0.25 and then to 0.15, respectively. The recovery rate achieved was 31±12, 89±8, and 93±7% where the droplet splitting microchannel ratios are 0.15, 0.25, and 0.35, respectively (FIG. 9*c*). In all cases, the edge of the electrode 144 was aligned with the upper side wall of the lower splitting microchannel, meaning that the distance between the edge of the electrode 144 and the microchannel wall was adjusted as being the same width as the lower splitting microchannel depending on the splitting channel ratios. Thus, as the ratio decreased, the edge of the electrode 144 became closer to the side of the droplet where the internal circulating flow field force was stronger than the DEP force applied. Consequently, the recovery efficiency began to decrease. Nevertheless, the presented DEP-based in-droplet particle concentrator could generate daughter droplets that have 6 times lower volume than the mother droplets, with more than a 90% particle recovery rate. FIG. 10 shows the regression analyses of the concentration recovery rate for varying number of PS particles within the droplet to characterize whether the number of particles inside the droplet influenced the recovery rate. In most cases (except for the case of 10 Vpp applied voltage and the case of splitting channel ratio of 0.15), even when the particle number inside the droplet increased to more than 60, no difference in recovery rate was observed.

Example 2

Figure 11:
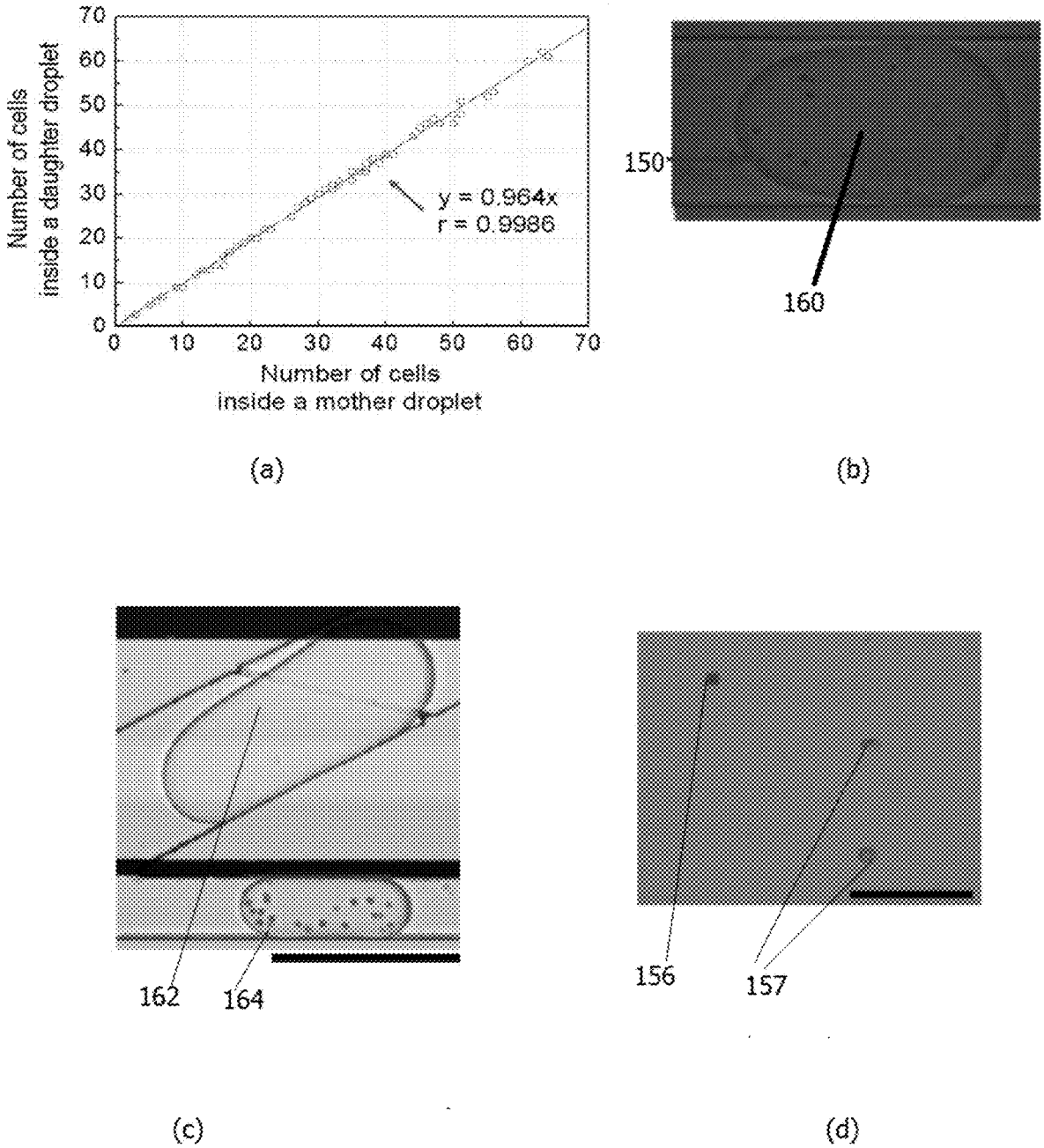
FIG. 11 shows recovery of green microalga *Chlamydomonas reinhardtii* CC-406 cells. (a) Regression analysis of cell recovery rate for different CC-406 cell concentrations when using the condition of 20 V peak-to-peak voltage (Vpp), 20 μl/h total flow rate, and 0.35 droplet splitting channel ratio. (b) CC-406 cells suspended in the TAP culture media was encapsulated and injected into the cell concentrator microchannel of the DEP in-droplet cell concentrator. (c) CC-406 cells inside the droplet were repelled by the negative DEP force and accumulated into the bottom side of the droplet. A daughter droplet in the lower splitting channel with highly concentrated CC-406 cells was obtained after the droplet splitting step (scale bar: 200 μm). (d) Microscopic images showing live/dead image assay (scale bar: 50 μm)

Referring to FIG. 11, to test whether the presented platform can be used as an in-droplet cell concentrator for a cellular assay based on droplet microfluidics, photosynthetic microalga *Chlamydomonas Reinhardtii* were encapsulated inside the droplets and tested. Microalgae were selected in this example bioassay as they are photosynthetic microorganisms that are promising producers of renewable biofuel. Developing microalgal strains showing enhanced growth rates and increased lipid productivity through genetic and metabolic engineering is one promising approach towards economically viable production of biofuel. As such, several microfluidic platforms, including droplet microfluidics platform for high-throughput screening, have been developed for such purposes. By using the DEP in-droplet cell concentrator, *C. reinhardtii* strain CC-406 cells suspended in tris-acetate-phosphate (TAP) media were first encapsulated in droplets, followed by droplet introduction into the particle or cell-concentration microchannel at a total flow rate of 20 $\mu l\ h^{-1}$. CC-406 cells inside droplets were gradually concentrated to one side of the droplet when a 500 kHz, 20 $V_{pp}$ sinusoidal signal was applied. These mother droplets were then split into two daughter droplets using a splitting channel ratio of 0.35. The recovery rate achieved was 98±3%. In FIG. 11*b*, cells 150 are CC-406 cells in a droplet 160. After droplet splitting (FIG. 11*c*), the daughter droplets 164 containing CC-406 cells were collected and cells were dyed with Evans blue (E2129, Sigma Aldrich) to verify cell viability (FIG. 11*d*), 156 is a dead cell and 157 are live cells. Cell viability was 98%, thus the applied voltage and DEP force did not affect cell viability. FIG. 11*a* further shows the regression analysis of in-droplet cell concentration dependent recovery rate for varying number of CC-406 cells within the droplet. Consequently, showing the microalgae accumulation inside droplet using the DEP concentrator would be expected to lead to a new way to support extensive research in the field of the microalge as well as other applications related to cellular assay based on droplet microfluidics.

The disclosed device and method provide a DEP-based in-droplet cell concentrator using a DEP force generated from gold surface electrodes inside a PDMS microchannel. Subsequent droplet splitting using a two-branch microchannel structure results in two daughter droplets, one containing highly concentrated cells and another being empty (or close to empty). Effective in-droplet concentration was demonstrated using both PS microparticles and microalgal cells. The disclosed device and method can add a new fundamental liquid/particle handling step in droplet microfluidics, where in-droplet cell concentration followed by droplet splitting can be used to increase or adjust the concentration of cells within a droplet by adjusting both the droplet splitting ratios and the degree of droplet movement. In addition, the split daughter droplet that contains all or most of the cells can then be merged with another droplet containing a different solution, thus re-suspending the cells in a different target media. In terms of function, both steps achieve a result similar to a conventional centrifugation step followed by re-suspension of the cell pellet in a desired target media, where the cell concentration can also be adjusted by how much media is added to the centrifuged cell pellet. In conclusion, the presented technology adds a new liquid/cell handling steps to droplet microfluidics that were previously very challenging to achieve, thus further expanding the type of biological assays achievable in droplet microfluidics format.

Example 3

In an embodiment, a device for particle and cell concentration inside droplets using dielectrophoretic force based microfluidic systems can comprise: a. The first layer comprising of a pair of angled electrodes for concentrating particles or cells into one side of a droplet; b. The second layer comprising of droplet generation, cell concentration and droplet splitting regions; c. Droplets can be generated using a T-junction or flow focusing structure. In a different application setting, previously formed droplets can be injected into the microchannel; d. The channel width can be adjusted depending on the droplet size, however, the channel height would be ideally below certain range (for example less than 50 μm), to be able to exert the strongest DEP force to the cells and particles within droplets; e. The highest electrical fields are generated between the edges of two electrodes where they are facing each other. The particles or cells can be attracted to or repelled from the edge of the electrodes by positive or negative dielectrophoresis force, respectively; f. The angle between the electrode and the direction of flow can be changed (for example up to 70 degree) depending on the size of particles or cells and length of the channel; g. The electrodes should cover the whole cell concentration microchannel except for the electrode gap if there is no dielectric layer on the metal layer. The shape of the gap between the two electrodes (present: straight electrode) can be changed to increase DEP force by increasing the surface area of the edge of the electrodes (such as using an interdigitated electrode design); h. The conductivity of media under 1 S/m is typically used, but not necessarily; and i. The splitting microchannel could be composed of two or more outlets. The patterned electrodes can be treated with a hydrophobic chemical or covered with an insulation layer.

Example 4

Figure 12:
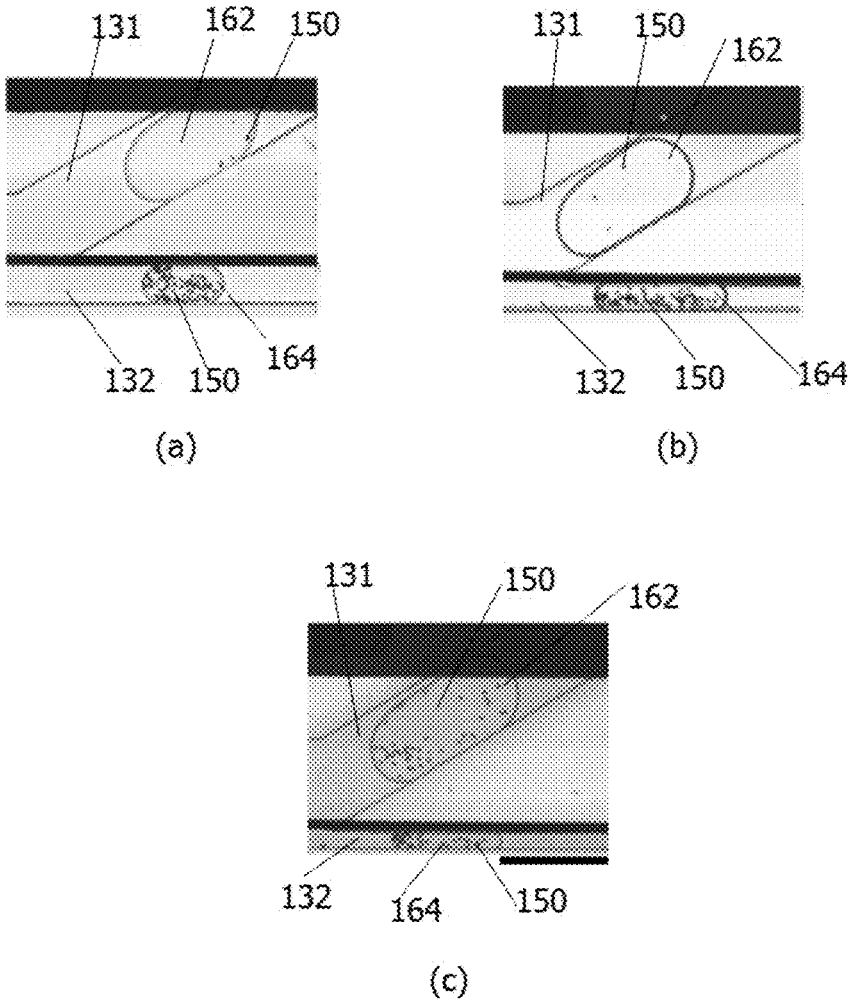
FIG. 12 shows microscopic images of particle dilution inside the daughter droplet by controlling the droplet splitting microchannel width ratios. The ratios of the daughter droplet #2 volume compared to the mother droplet volume are (a) 0.2, (b) 0.16, and (c) 0.13.

The concentration of cells/particles inside a droplet can be further adjusted by using a different droplet splitting microchannel width ratio (lower droplet splitting microchannel width vs the total microchannel width). FIG. 12 shows microscopic images of particle dilution inside the daughter droplet 164 by controlling the droplet splitting microchannel width ratios. To increase the cell/particle concentration inside the daughter droplet 164, the width of the lower splitting channel was decreased. The total microchannel width before the droplet splitting region was 200 μm and the lower droplet splitting widths were (a) 70 μm (b) 50 μm, and (c) 30 μm, resulting in droplet splitting microchannel width ratios of 0.3, 0.25 and 0.15, respectively. As the width of the lower splitting channel decreased, the volume ratio of the daughter droplet 164 compared to the mother droplet decreased from 20±1, 16±2, and 13±1% when the ratio of the splitting microchannel width decreased from 0.35 to 0.25 and then to 0.15, respectively. When calculating the achieved recovery rate of each case, the particle concentrations of the daughter droplet 164 were $6.2\times10^{11}$, $7.5\times10^{11}$, and $3.2\times10^{11}$ cells/ml when the droplet splitting microchannel width ratio was 0.35, 0.25, and 0.15, respectively, whereas the particle concentration in the mother droplet was $1.3\times10^{11}$ cells/ml. Even though the achieved recovery rate was decreased by increasing the flow field force acting on the particles when the ratio of the splitting microchannel width was 0.15 (FIG. 12*c*), the concentration of the particles was increased by 5.7-fold with the average recovery rate of 90% when the ratio of the splitting microchannel width was 0.25 (FIG. 12*b*).

Example 5

Figure 13:
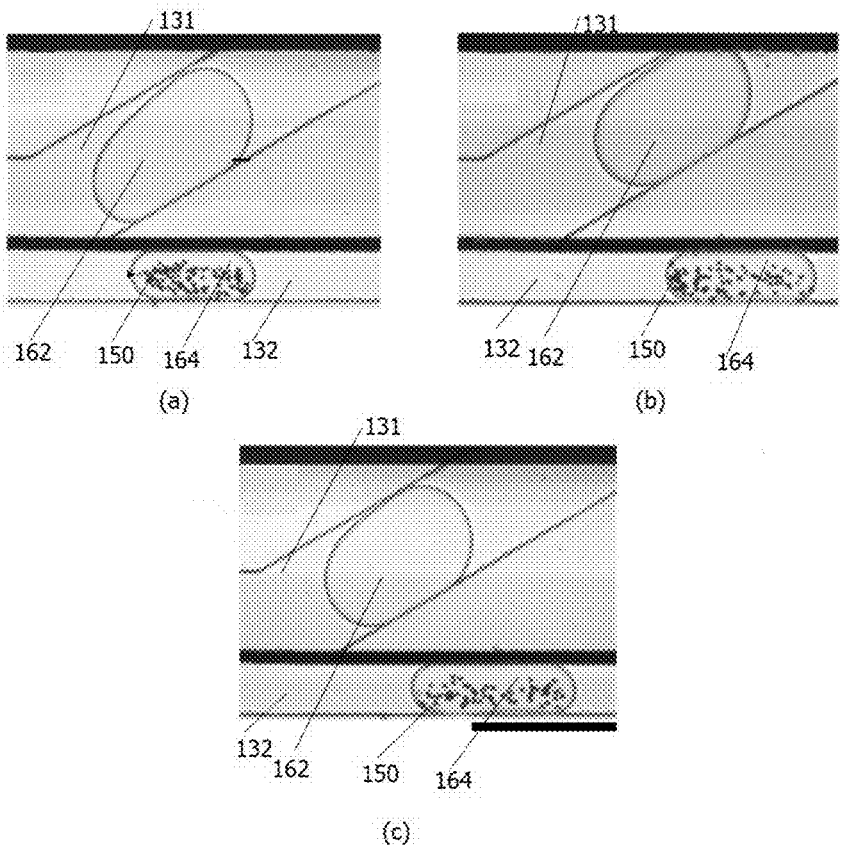
FIG. 13 shows microscopic images of particle dilution inside the daughter droplet #2 by controlling the suction flow rate from the outlet of the daughter droplet #1. The ratios of the daughter droplet #2 volume compared to the mother droplet volume are (a) 0.23, (b) 0.26, and (c) 0.3.

Referring to FIG. 13, another method to adjust particle concentration of the daughter droplet 164 is by applying different levels of negative pressure through the outlet of the daughter droplet 162. A syringe pump (not shown) coupled to the splitting microchannel 131 was used to control the suction (i.e., reverse) flow rate as 11 (FIG. 13*a*), 9 (FIG. 13*b*), and 7 μl/ml (FIG. 13*c*) to generate daughter droplet 164 having volume ratios compared to the mother droplet volume as 0.23, 0.26, and 0.3, respectively. The resulting particle concentration of the daughter droplet 164 was decreased from $5.8\times10^{11}$ to $5.1\times10^{11}$ and then to $4.5\times10^{11}$ cells/ml, with 99±1% recovery rate where the suction flow rates were 11, 9, and 7 μl/ml, respectively. Thus, particle dilution inside a droplet is implemented by adjusting the suction flow rate without any sample loss.

Example 6

Figure 14:
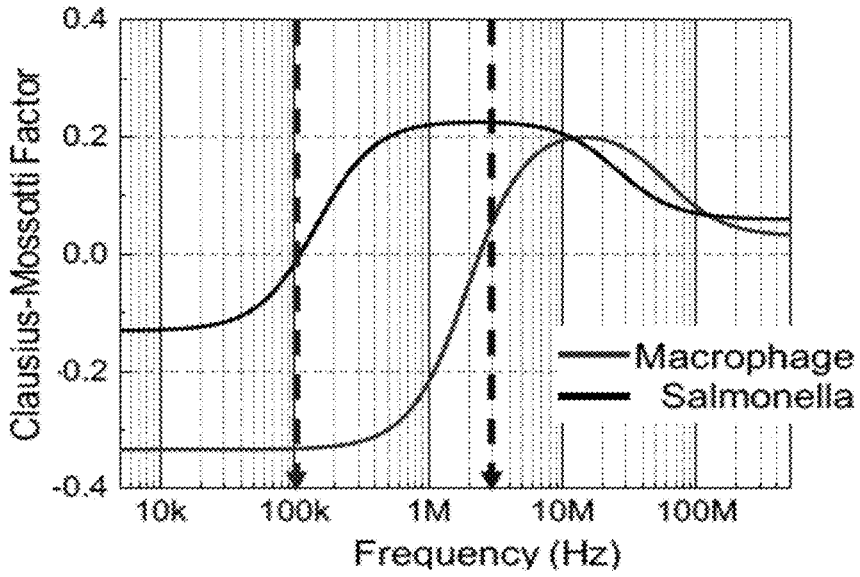
FIG. 14 shows the calculated real part of Clausius-Mossotti factor of macrophage and *Salmonella* suspended in low conductivity media (0.03 S/m)

DEP polarity acting on cells is determined by their Clausius-Mossotti factor. If the real part of Clausius-Mossotti factor has negative or positive value at certain frequency, nDEP or pDEP force will be respectively generated. Thus, at the edge of the electrode, cells are repelled by the generated nDEP force or can be attracted by the generated pDEP. Derived from their dielectric properties, FIG. 14 shows that two different types of cells, in this case macrophages and *Salmonella* will experience opposite polarity DEP forces at 500 kHz frequency. At other frequencies, such as 100 kHz, *Salmonella* will experience no DEP force, while macrophages will experience negative DEP force. At other frequencies, such as 3 MHz, macrophages will experience no DEP force, while *Salmonella* will experience positive DEP force.

Figure 15:
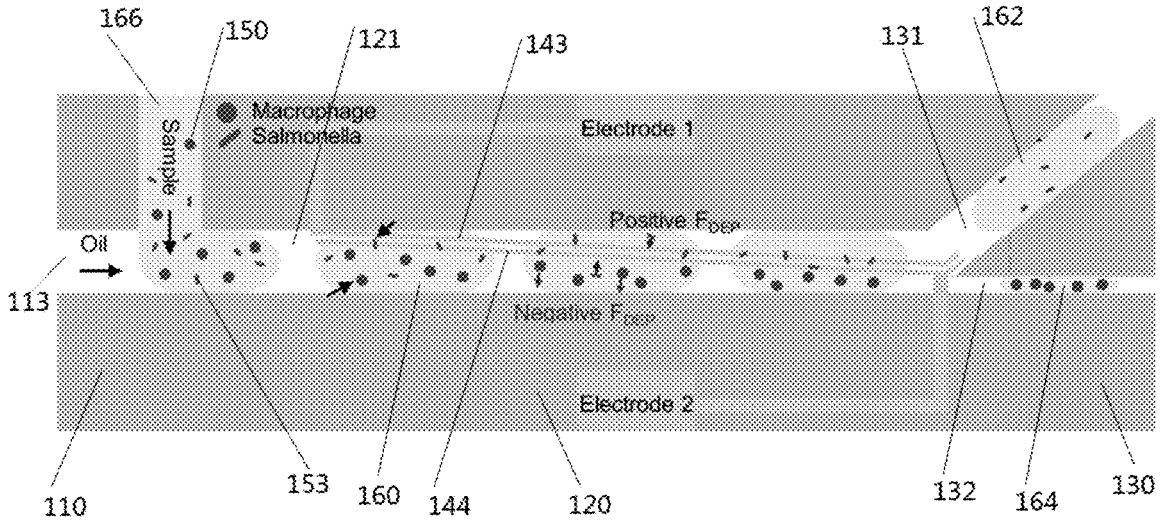
FIG. 15 shows a schematic view of a DEP polarity-based cell manipulation system.

The opposite DEP polarity acting on different cell types can also be utilized for cell manipulation inside droplet, resulting in selectively concentration of target cells in one of daughter droplets for downstream analysis. Referring to FIG. 15, the microfluidic device is composed of three parts, droplet generation 110, in-droplet selective cell concentrator 120 using DEP force, and droplet splitting 130.

The sample 166 containing two different types of cells (macrophages 150 and *Salmonella* cells 153) was injected into the device, which was encapsulated in water-in oil emulsion droplets. An angled electrode pair 143, 144 was patterned on a glass substrate underneath the cell manipulation microchannel where the non-uniform electric field is strongest at the edge of the electrodes. As the generated 120 μm diameter droplets 160 were passing through the concentration microchannel 121 with 50 μl/h flow rate, electrode pair 143, 144 with 15 μm gap being tilted at 0.3° was conducted under 45 V peak to peak applied voltage at 500 kHz frequency, and the cells inside the droplets experienced DEP force generated from the electrode edges with different polarity. In other words, macrophages 150 experienced nDEP force and repelled from the electrode edges, resulting in cells concentration towards the lower side of the droplet. On the other hand, pDEP force acting on *salmonella* 153 made them migrate towards the electrodes, then continuously moving along with the electrode edges once they are trapped. When the droplet 160 reached to the asymmetric Y-shaped splitting region of the droplet splitting 130, two daughter droplets having different sizes were obtained; daughter droplet 164 containing all or most of macrophages 150 is in the splitting microchannel 132, while daughter droplet 162 having the majority of *Salmonella* cells 153 in the splitting microchannel 131. The position of the electrode pair in the microchannel was aligned in such a way that the end of the paired electrode is above the. Y-shaped splitting region so that *Salmonella* cells that are attracted to the electrode gap remains in the upper daughter droplet 162.

Figure 16:
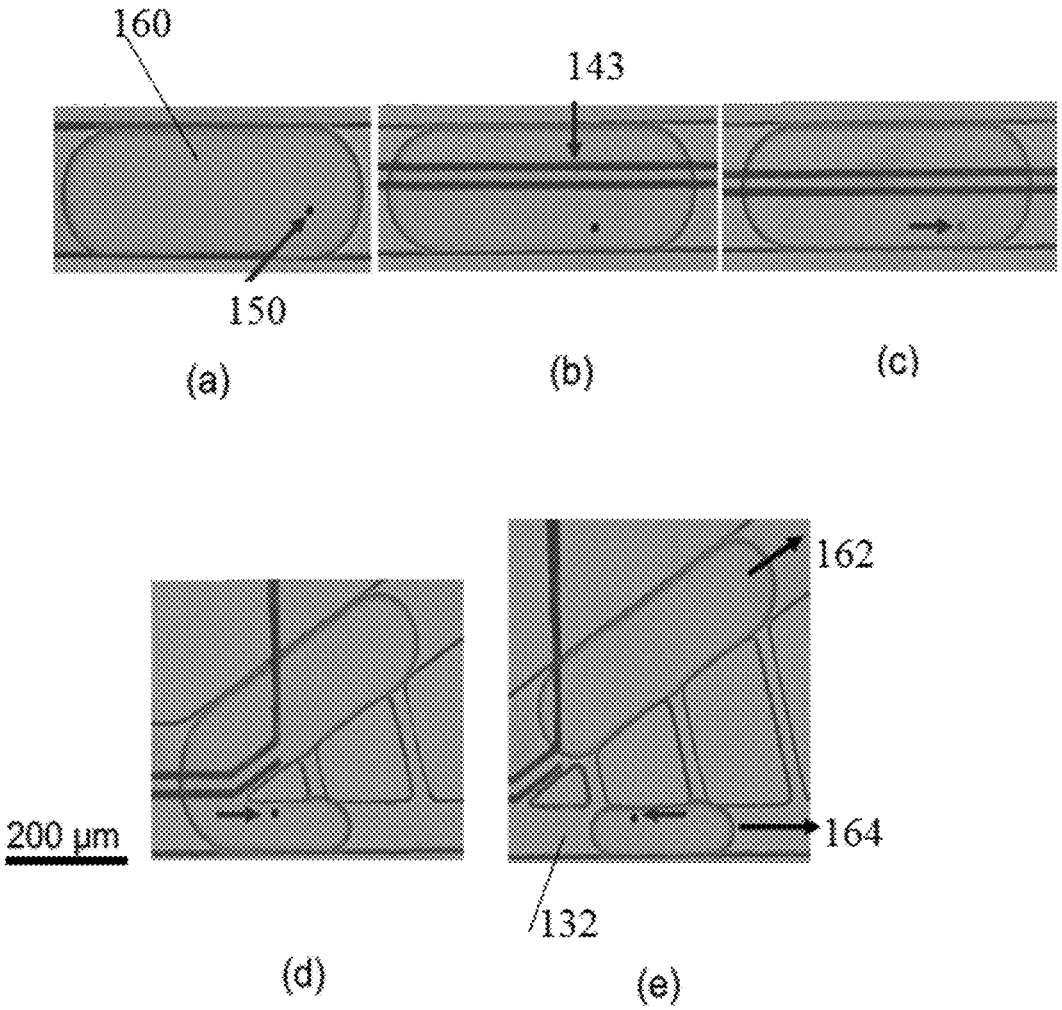
FIG. 16 shows a microscopic image of macrophages inside a flowing droplet, from upstream (left) to downstream (right) of the microchannel that has the angled pair of DEP electrodes, wherein (a) macrophage-encapsulated droplets flow into the particle or particle or cell-concentration channel. (b)-(c) macrophages inside a droplet were repelled from the edge of the electrodes and gradually focused into one side of the droplet. (d)-(e) Daughter droplet with all the accumulated macrophages was formed by a two-branch asymmetric droplet splitting microchannel (scale bar: 200 μm)
Figure 17:
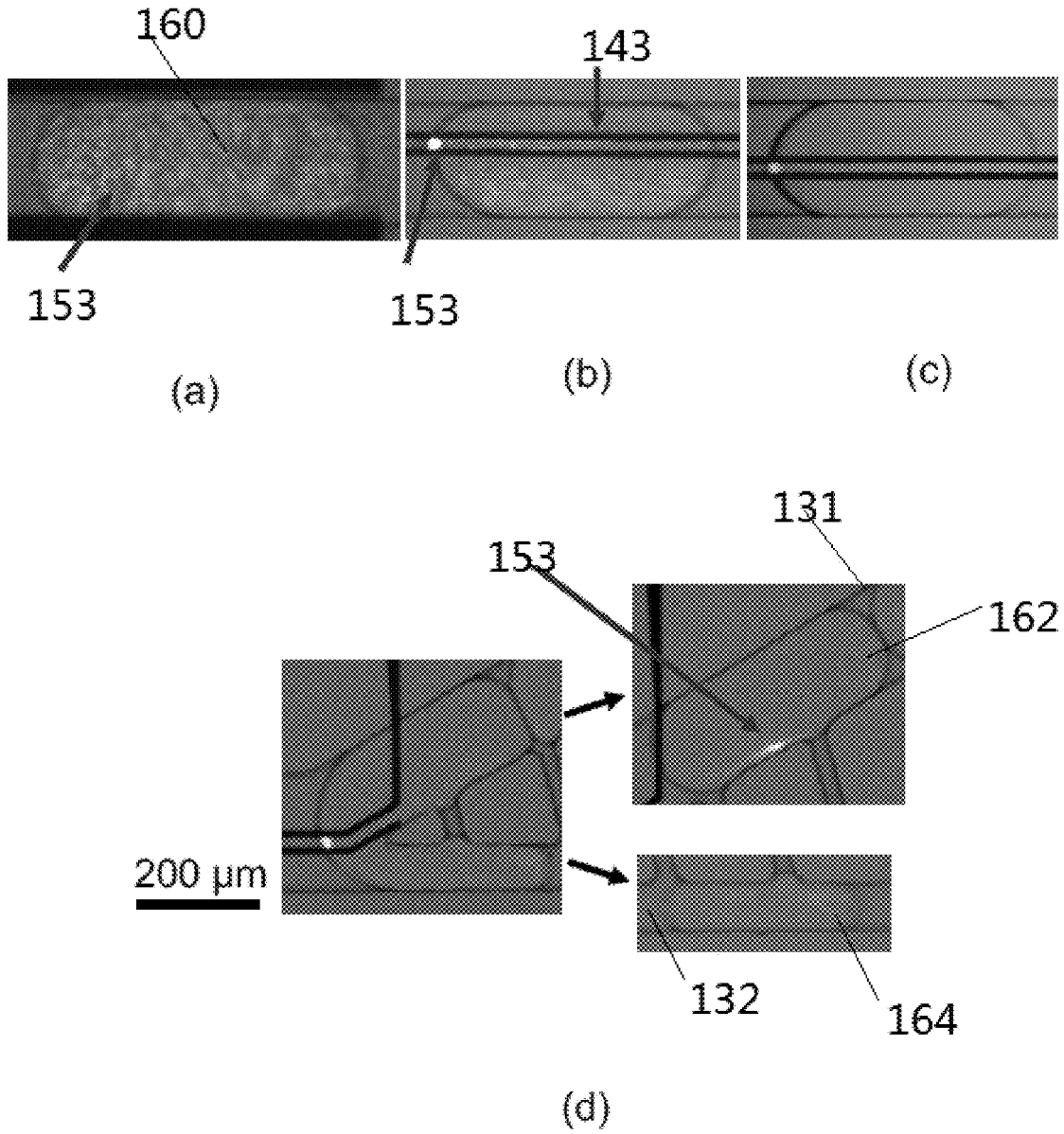
FIG. 17 shows microscopic images of *salmonella* cells inside a flowing droplet, from upstream (left) to downstream (right) of the microchannel that has the angled pair of DEP electrodes, wherein (a) *Salmonella* cell-encapsulated droplets flow into the particle or particle or cell-concentration channel. (b)-(c) *Salmonella* cells inside a droplet were attracted towards the edge of the electrodes and gradually focused into one side of the droplet. (d) Daughter droplet with all the accumulated *Salmonella* cells was formed by a two-branch asymmetric droplet splitting microchannel (scale bar: 200 μm)
Figure 18:
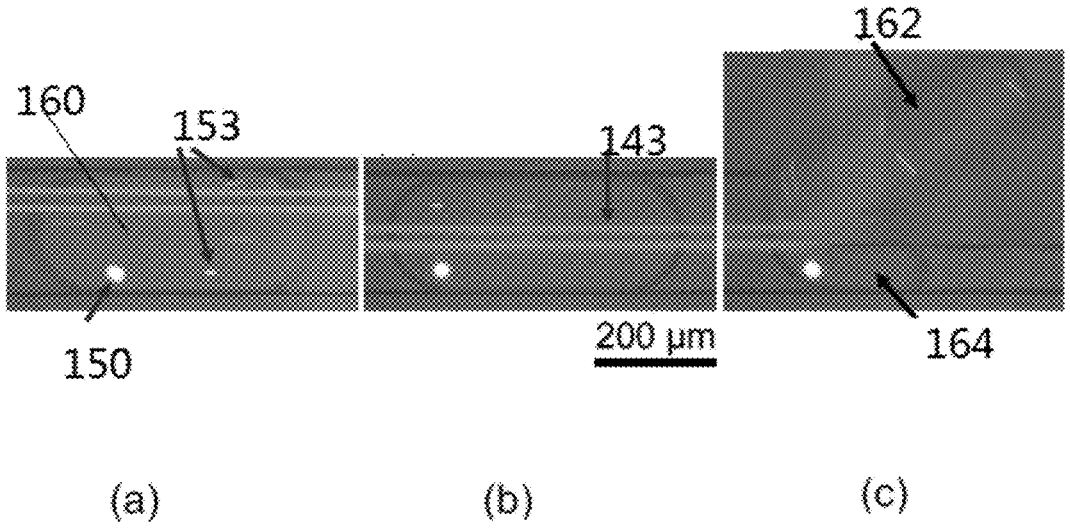
FIG. 18 shows microscopic images of mixed macrophages and *Salmonella* cells inside a flowing droplet, from upstream (left) to downstream (right) of the microchannel that has the angled pair of DEP electrodes, wherein (a) macrophages and *Salmonella*-encapsulated droplets flow into the particle or cell-concentration channel. (b) macrophages and *Salmonella* inside a droplet were repelled and attracted by the electrodes, respectively, and gradually focused into two sides of the droplet. (c) daughter droplets with accumulated macrophages and *Salmonella* cells, respectively, are formed by a two-branch asymmetric droplet splitting microchannel (scale bar: 200 μm)

FIG. 16(*a*)-16(*e*) show that macrophage 150 in droplet 160 was repelled from the electrode pair by the generated nDEP force, resulting in confinement of cell position into the lower side of the droplet, following by cell separation into daughter droplet 164. FIG. 17(*a*)-17(*d*) shows that *Salmonella* cells were attracted toward the electrode edges by generated pDEP force, resulting in cell accumulation between the electrode edges at the rear of the moving droplet. Most of the Salmonellas cells were separated into daughter droplet 162 after droplet splitting. FIG. 18(*a*)-18(*c*) show that macrophage 150 and Salmonellas cells 153 were gradually moved towards the lower and upper side of the droplet, resulting in separation into daughter droplet 162 and 164, respectively.

In an embodiment, the cell preparation is as follows: the macrophages (J774A.1 (ATCC TIB67)) were grown on a cell culture flask with DMEM containing 10% FBS and incubated at 37° C. in a 5% $CO_2$ atmosphere. Macrophages cells were detached by a cell scraper prior to experiment and stained with live/dead Baclight staining dye (Thermo Fisher, USA). After staining and rinsing steps, macrophages cells were suspended in low conductivity media at an adjusted concentration to reach a single cell per droplet of *Salmonella typhimurium* strain (ATCC 14028S) engineered with a GFP plasmid (pCM18) were inoculated on Luria broth (LB) agar plate, and a single colony was picked and cultured in LB broth overnight. The next day, the bacteria culture was centrifuged and washed with the same low conductivity media. Cell suspension media was diluted 50 times from OD of 1.0 to get 20-30 bacteria cells per droplet.

The microfluidic device was made of polydimethylsiloxane (PDMS, Dow Corning, MI) on a 0.7 mm thick borosilicate glass substrate with patterned electrode. The angled electrode pair was prepared by conventional photolithography, including Cr/Au (20 nm/100 nm) deposition on the glass substrate, patterning of an etch mask using AZ1518 photoresist (AZ electronic Materials, USA), selective metal etching of Cr and Au layer, followed by the etch mask removal. A SU-8 2025 photoresist (Microchem, USA) was used to fabricate a 30 μm thick layer of SU-8 master mold. The liquid phase PDMS (mixed at a ratio of 10:1 base and curing agent) was poured onto the SU-8 master mold and cured for 30 min at 85° C. After oxygen plasma treatment of both the electrode patterned glass substrate and the PDMS replica, they were aligned and bonded together for 24 hr at 85° C.

Two surface coating materials were used to make the surfaces of gold, glass substrate, and PDMS microchannel hydrophobic. To obtain hydrophobic gold surface, a precious metal treatment (Aculon, Inc., CA) solution was injected into the microchannel and then dried at 85° C. After that, the microchannel was treated with Aquapel™ (Pittsburgh Glass Works, LLC, PA) solution, followed by drying with air.

Example 7

FIG. 14 shows that the real part of the Clausius-Mossotti factor of *Salmonella* at 100 KHz, or the real part of Clausius-Mossotti factor of macrophages at 3 MHz are near 0, which means *Salmonella* will experience zero polarity DEP force at 100 KHz and macrophages will experience zero polarity DEP forces at 3 MHz frequency. The different DEP response under specific frequency range acting on different cell types can also be utilized for in-droplet cell separation.

Figure 19:
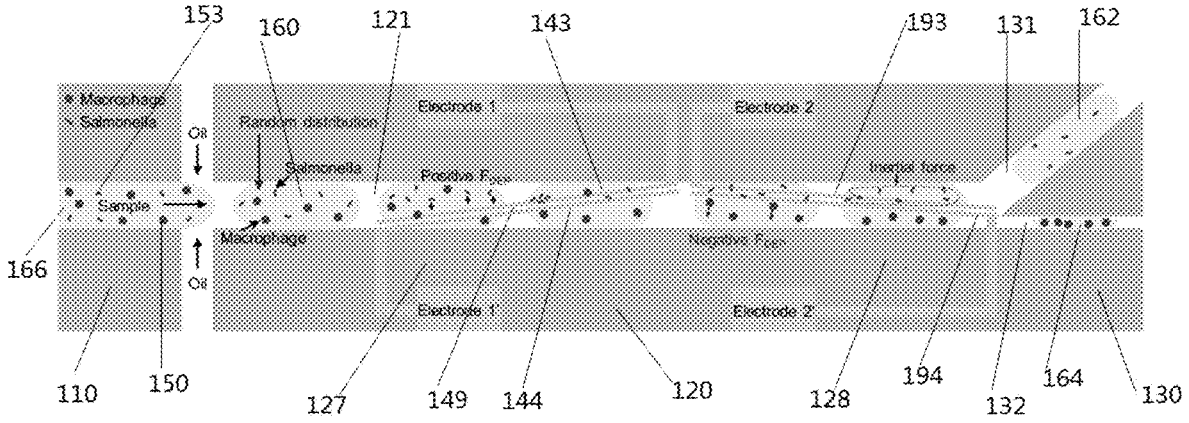
FIG. 19 shows schematic view of an in-droplet cell separation system based on different DEP response of two different types of cells (or cells of different dielectric properties and/or sizes) under the specific frequency range.

Referring to FIG. 19, the microfluidic device is composed of three parts, droplet generation 110, cell concentrator 120 using DEP force, and droplet splitting 130. The cell concentrator 120 includes a pDEP force concentrator 127 and a nDEP force concentrator 128. The pDEP force concentrator 127 has an angled electrode pair 143, 144 at the bottom of the microfluidic channel 121 forming a gap 149 therebetween and is placed at an ascendant angle to the flow direction of the microchannel. The nDEP force concentrator 128 has an angled electrode pair 193, 194 at the bottom of the microfluidic channel 121 forming a gap therebetween and is placed at a declining angle to the flow direction of the microchannel.

The sample 166 containing two different types of cells (macrophages 150 and *Salmonella* cells 153) was injected into the device, which was encapsulated in water-in oil emulsion droplets. Macrophages 150 and *Salmonella* cells 153 were randomly distributed after droplet generation. As the generated droplets 160 were passing through the pDEP force concentrator 127, a 3 MHz, 20 Vpp sinusoidal voltage was applied to the planar electrodes 143, 144 of the pDEP force concentrator 127. In this case macrophages 150 remain randomly distributed because they were barely affected by DEP force at 3 MHz, while *Salmonella* concentrated at the top. When the generated droplets 160 were passing through the nDEP force concentrator 128, a 100 KHz, 8 Vpp sinusoidal voltage was applied to the planar electrodes 193, 194 of the nDEP force concentrator 128. In this case macrophages 150 migrated to the lower side while *Salmonella* cells 153 stayed mostly at the upper side of the droplet 160. When the droplet 160 reached to the asymmetric Y-shaped splitting region of the droplet splitting 130, two daughter droplets having different sizes were obtained; daughter droplet 164 containing all or most of macrophages 150 is in the splitting microchannel 132, while daughter droplet 162, having the majority of *Salmonella* cells 153, is in the splitting microchannel 131.

Figure 20:
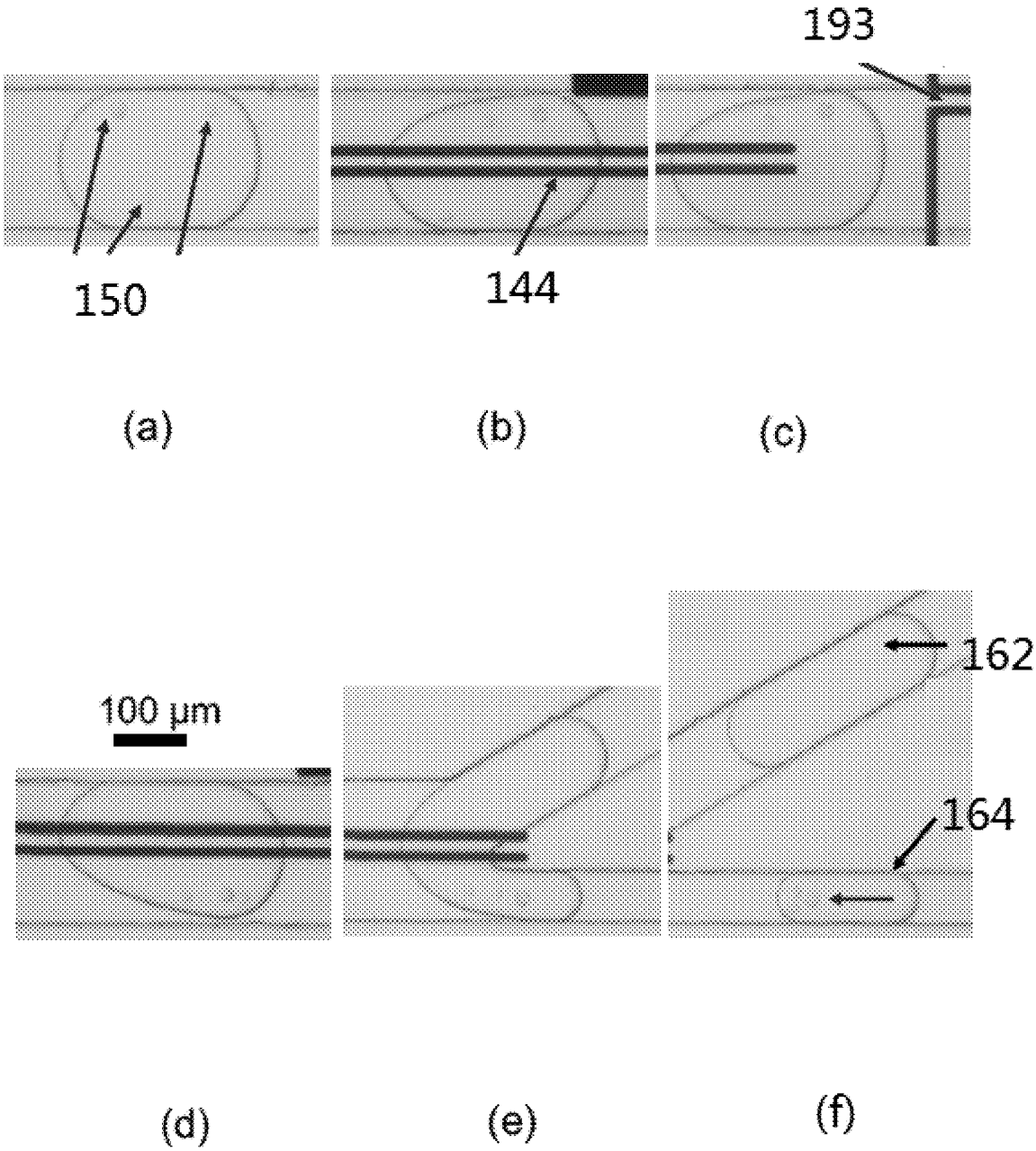
FIG. 20 shows microscopic images of macrophages inside a flowing droplet, from upstream (left) to downstream (right) of the microchannel that has two angled pair of DEP electrodes, wherein (a) macrophage-encapsulated droplets flow into the particle or particle or cell-concentration channel. (b)-(c) macrophages were suspend in the droplet when passing through the first pair of electrodes (100 kHz, 8 $V_{pp}$ sinusoidal voltage). (d)-(e) macrophages inside a droplet were repelled from the edge of the second pair of electrodes by Ndep and gradually focused into one side of the droplet. (f) daughter droplet with all the accumulated macrophages was formed by a two-branch asymmetric droplet splitting microchannel (scale bar: 100 μm)

FIG. 20(*a*)-20(*f*) show that at first, macrophages were randomly distributed in a generated droplet. When a 3 MHz, 20 Vpp sinusoidal voltage was applied on the electrode pair 143, 144, they were barely affected by DEP force. When a 100 KHz, 8 Vpp sinusoidal voltage was applied to the planar electrodes 193, 194, nDEP force generated from electrode pair 193, 194 repelled and accumulated the macrophages towards the lower side of the droplet. All macrophages were contained into daughter droplet 164 after splitting.

Figure 21:
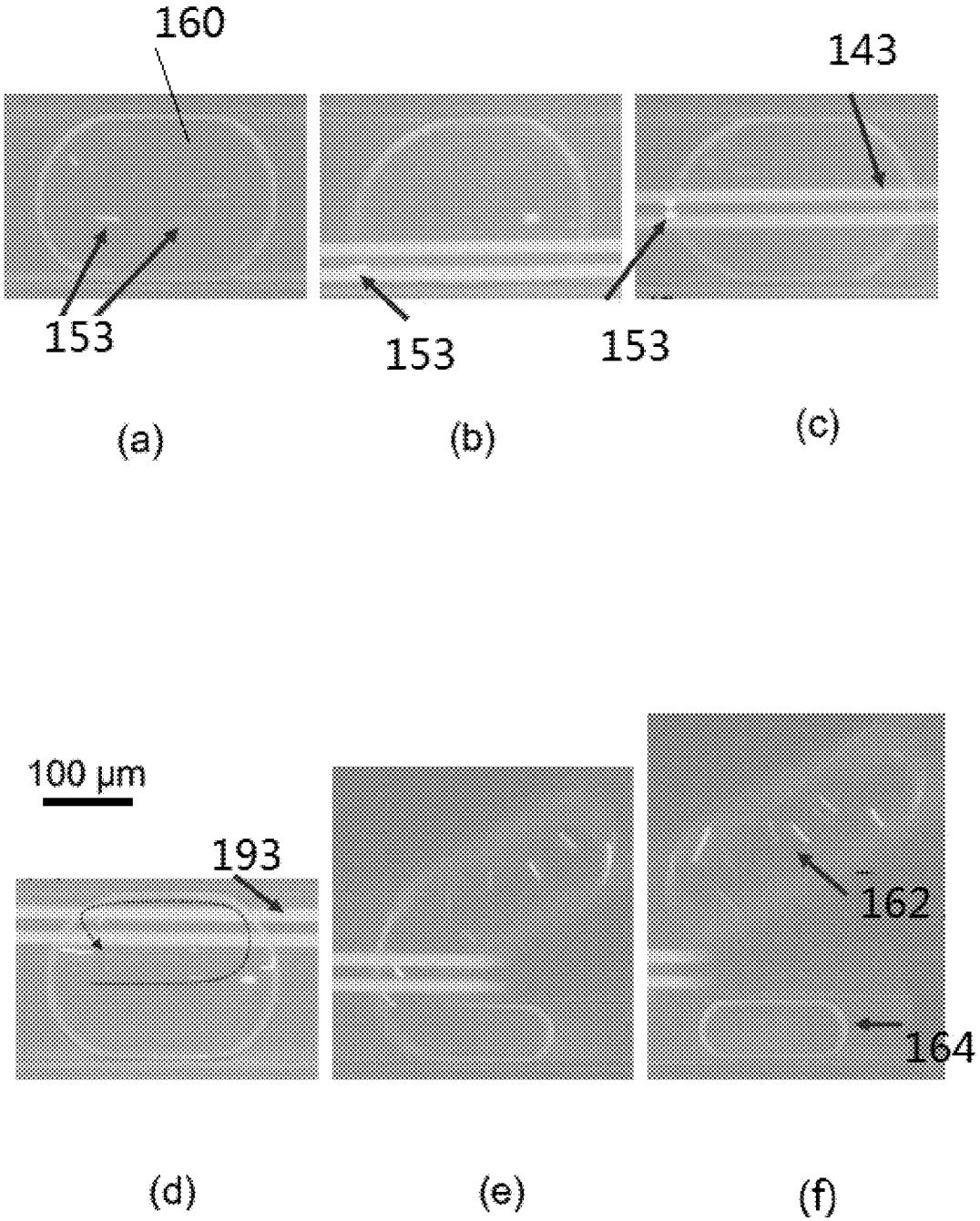
FIG. 21 shows microscopic images of *Salmonella* cells inside a flowing droplet, from upstream (left) to downstream (right) of the microchannel that has two angled pair of DEP electrodes, wherein (a) *Salmonella*-encapsulated droplets flow into the particle or particle or cell-concentration channel. (b)-(c) *Salmonella* cells were accumulated by pDEP force when passing through the first pair of electrodes (3 MHz, 20 $V_{pp}$ sinusoidal voltage). (d)-(e) *Salmonella* cells inside a droplet were shown circulating by internal force in the upper half of the droplet. (f) daughter droplet with all the accumulated *Salmonella* cells was formed by a two-branch asymmetric droplet splitting microchannel (scale bar: 100 μm)

FIG. 21(*a*)-20(*f*) show that at first, *Salmonella* cells 153 were randomly distributed in a generated droplet 160. When a 3 MHz, 20 Vpp sinusoidal voltage applied on the electrode pair 143, 144, the *Salmonella* cells were accumulated by pDEP force at the gap of the electrodes in the rear of the droplet 160. When a 100 KHz, 8 Vpp sinusoidal voltage was applied to the planar electrodes 193, 194, *Salmonella* cells inside the droplet were circulated by internal force in the upper half of the droplet 160. All macrophages were contained into daughter droplet 162 after splitting.

Figure 22:
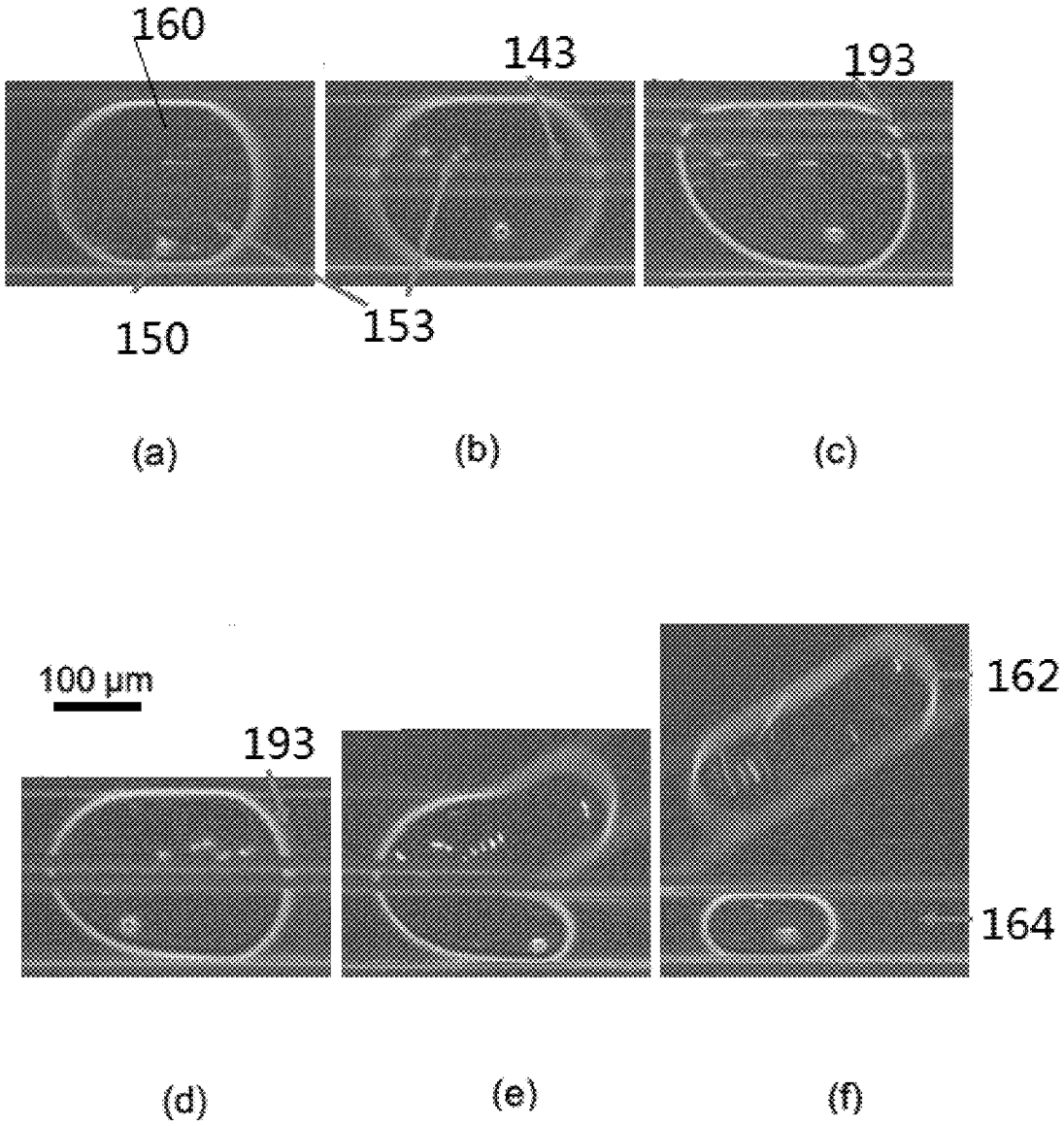
FIG. 22 shows microscopic images of mixed macrophages and *Salmonella* cells inside a flowing droplet, from upstream (left) to downstream (right) of the microchannel that has two angled pair of DEP electrodes, wherein (a) macrophage- and *Salmonella*-encapsulated droplets flow into the particle or particle or cell-concentration channel. (b)-(c) *Salmonella* cells were accumulated by pDEP force when passing through the first pair of electrodes (3 MHz, 20 $V_{pp}$ sinusoidal voltage). (d)-(e) macrophages inside a droplet were repelled from the edge of the second pair of electrodes by nDEP (100 KHz, 8 $V_{pp}$ sinusoidal voltage) and gradually focused into one side of the droplet. (f) daughter droplets with accumulated macrophages and *Salmonella* cells, respectively, are formed by a two-branch asymmetric droplet splitting microchannel (scale bar: 100 μm).

FIG. 22(*a*)-22(*f*) shows that mixed macrophages 150 and *Salmonella* cells 153 were gradually moved towards the lower and upper side of the droplet 160 using two electrode pairs 143, 144 and 193, 194 based on the different DEP response, resulting in separation into daughter droplets 162 and 164, respectively.

A method for particles and cells concentration using dielectrophoresis inside a droplet can comprise: utilizing the droplet generator using two immiscible solutions or injection of droplets that previously contained the particles or cells; utilizing the positive or negative dielectrophoretic force change over a range of frequency depending on dielectric properties of particles or cells or media to move cells and particles to one side of the droplet; and utilizing the splitting microchannel to create two or more daughter droplets form the mother droplet, wherein one daughter droplet contains a majority of (or all) cells, while the other droplet contains a minimum number of cells (or none).

A method for particles and cells concentration using dielectrophoresis inside a droplet, can further comprise droplet splitting, selecting the daughter droplet that contains most of the cells, and merging this droplet with another droplet containing a desired reagent, thus resulting in concentrated cells to be resuspended in the desired media, resulting in solution exchange.

All of the compositions and methods disclosed and claimed herein can be made and executed without undue experimentation in light of the present disclosure. While the compositions and methods of this disclosure have been described in terms of preferred embodiments, it will be apparent to those of skill in the art that variations may be applied to the compositions and methods and in the steps or in the sequence of steps of the methods described herein without departing from the concept, spirit and scope of the disclosure. More specifically, it will be apparent that certain agents which are both chemically related may be substituted for the agents described herein while the same or similar results would be achieved. All such similar substitutes and modifications apparent to those skilled in the art are deemed to be within the spirit, scope and concept of the disclosure as defined by the appended claims.

What is claimed is:

1. A device for concentrating materials comprising a material concentration microchannel coupled with one or more pairs of electrodes with a gap formed therebetween and positioned at a bottom of the concentration microchannel;

a droplet splitting part connecting to the concentration microchannel;

wherein voltage on the one or more pairs of electrodes creates an electric field across the concentration microchannel to generate a dielectrophoresis (DEP), force on the material in a droplet such that the material is concentrated in the droplet, and wherein the gap formed between the one or more pairs of electrodes extends at an acute angle that is 45 degrees or less to a flow direction of the concentration microchannel to gradually concentrate the material to one side of the droplet;

wherein the droplet splitting part has at least two microchannels to separate the droplet into at least two daughter droplets having a different material concentration or different properties.

2. The device of claim 1, wherein a cross section shape of the concentration microchannel is rectangular and the width and the height of the concentration microchannel is between 1 μm to 10 mm.

3. The device of claim 2, wherein the concentration microchannel is between 20 μm to 2 mm wide and between 10 μm and 1 mm high.

4. The device of claim 1, wherein the one or more pairs of electrodes are planar electrodes.

5. The device of claim 1, wherein the acute angle is 1.37 degrees.

6. The device of claim 1, wherein the one or more pairs of electrodes cover the whole concentration microchannel except for two parallel electrode gaps.

7. The device of claim 1, wherein the one or more pair of electrodes are replaced by interdigitated multiple pairs of electrodes.

8. The device of claim 1, wherein the one or more pairs of electrodes are covered by a dielectric layer.

9. The device of claim 1, wherein the inner surface of the concentration microchannel comprises a hydrophobic layer.

10. The device of claim 1, further comprising an encapsulated droplet generation module.

11. The device of claim 1, wherein the at least two microchannels of the droplet splitting part are asymmetric.

12. The device of claim 1, wherein a ratio of a width of a first microchannel of the at least two microchannels of the droplet splitting part to a width of the material concentration microchannel is less than 0.5.

13. The device of claim 1, wherein the bottom of the concentration microchannel is defined by a surface of a substrate and wherein the one or more pair of electrodes are positioned on the surface of the substrate.

14. A device for concentrating at least two kinds of materials inside a droplet comprising a material concentration microchannel coupled with at least two pairs of electrodes;

a droplet splitting part connecting to the concentration microchannel;

wherein a voltage at a frequency on one of the at least two pairs of electrodes creates electric field across the concentration microchannel to generate a first dielectrophoresis (DEP) force on one kind of material in a droplet such that the one kind of particles or cells are concentrated in one place of the droplet;

wherein another voltage at another frequency on another of the at least two pairs of electrodes creates electric field across the concentration microchannel to generate a second DEP force on a different kind of material in the droplet such that the different kind of material are concentrated in a different place of the droplet; and wherein the droplet splitting part has at least two microchannels to separate the droplet into at least two daughter droplets having different kinds of material.

15. The device of claim 14, wherein:

the voltage and the frequency on the one of the at least two pairs of electrodes comprises a first voltage and a first frequency, and the another voltage and the another frequency on the another of the at least two pairs of electrodes comprises a second voltage and a second frequency which are each different from the first voltage and the first frequency; and the first DEP force comprises a negative DEP force and the second DEP force comprises a positive DEP force.

16. A method for separation or concentration of materials inside a droplet, comprising driving the droplet to flow through a concentration microchannel;

utilizing a positive or negative dielectrophoretic force to move materials in the droplet to one side of the droplet in the concentration microchannel by applying voltage on one or more pairs of electrodes coupled to the concentration microchannel, wherein a gap is formed between the one or more pair of electrodes and which is positioned at a bottom of the concentration microchannel and extends at an acute angle that is 45 degrees or less to a flow direction of the concentration microchannel to gradually concentrate the materials to the one side of the droplet;

creating at least two daughter droplets from the droplet in a splitting microchannel, wherein one daughter droplet comprises a majority of materials and the other at least one daughter droplet comprises a minority of the materials.

17. The method of claim 16, wherein a recovery rate of the materials can be changed by adjusting the applied voltage on the one or more pairs of electrodes.

18. The method of claim 16, wherein a recovery rate of the materials can be changed by adjusting a flow rate of the droplets.

19. The method of claim 16, wherein a recovery rate of the materials can be changed by adjusting droplet splitting channel ratio.

20. The method of claim 16, further comprising merging the one daughter droplet with another droplet comprising a desired reagent, wherein the result is concentrated materials for resuspension in a desired media, resulting in solution exchange.

21. A device for washing materials and replacing a solution in which the materials are suspended in a desired solution comprising a materials concentration microchannel coupled with one or more pairs of electrodes;

a droplet splitting part connecting to the material concentration microchannel;

wherein the droplet splitting part has at least two microchannels to separate the droplet into at least two daughter droplets having a different material concentration;

wherein voltage on the one or more pairs of electrodes creates an electric field across the material concentration microchannel to generate a dielectrophoresis (DEP) force on the materials in a droplet such that the materials are concentrated to one side or both sides of the droplet; and a droplet merging part where a second droplet comes in that contains a desired solution;

wherein the droplet merging part is configured to merge together at least one of the daughter droplets containing the materials with the second droplet containing to achieve replacement of the solution.

* * * * *